US012509262B2

(12) United States Patent
Whitten et al.

(10) Patent No.: US 12,509,262 B2
(45) Date of Patent: Dec. 30, 2025

(54) CUT-OFF SYSTEM FOR CONTAINER CARRIER APPLICATING MACHINE

(71) Applicant: ILLINOIS TOOL WORKS INC., Glenview, IL (US)

(72) Inventors: Jimmy D. Whitten, Westminster, SC (US); George Moreland, Greer, SC (US); Brian Williams, Simpsonville, SC (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 18/639,505

(22) Filed: Apr. 18, 2024

(65) Prior Publication Data

US 2024/0351723 A1 Oct. 24, 2024

Related U.S. Application Data

(60) Provisional application No. 63/460,496, filed on Apr. 19, 2023.

(51) Int. Cl.

| | |
|---|---|
| ***B65B 27/04*** | (2006.01) |
| ***B65B 41/04*** | (2006.01) |
| ***B65B 43/44*** | (2006.01) |
| ***B65B 61/06*** | (2006.01) |

(52) U.S. Cl.

CPC ..... *B65B 27/04* (2013.01); *B65B 41/04* (2013.01); *B65B 61/06* (2013.01); *B65B 43/44* (2013.01)

(58) Field of Classification Search

CPC ..... B65B 27/04; B65B 41/04; B65B 43/44; B65B 61/06

See application file for complete search history.

(56) References Cited

U.S. PATENT DOCUMENTS 3,032,943 A * 5/1962 Reimers ..... B65B 17/025 53/55
3,032,944 A * 5/1962 Hull ..... B65B 17/025 53/543
3,137,109 A * 6/1964 Rapata ..... B65D 71/50 53/398

(Continued)

FOREIGN PATENT DOCUMENTS

DE 102020126782 B3 2/2022

OTHER PUBLICATIONS

PCT International Search Report, Form PCT/ISA/210, for International Application PCT/US2024/025469, Aug. 1, 2024 (5 pages).

(Continued)

*Primary Examiner* — Thanh K Truong
*Assistant Examiner* — David G Shutty
(74) *Attorney, Agent, or Firm* — Pauley Erickson & Swanson

(57) ABSTRACT

A system, method and apparatus for applying container carriers to unitize a plurality of containers. A supply of container carriers are provided in connected sticks of two or more container carriers. An applicating drum is configured to accept a single container carrier stick from a queue and provide the container carrier stick to a supply of containers. A cutoff system is configured to cut the sticks of two or more container carriers into individual container carriers but not cut between adjacent unconnected sticks of container carriers.

13 Claims, 38 Drawing Sheets

(56) References Cited

U.S. PATENT DOCUMENTS 3,204,386 A * 9/1965 Creed ..... B65B 17/025 53/134.1
3,383,828 A * 5/1968 Cunningham ..... B65B 17/025 206/150
3,404,505 A * 10/1968 Hohl ..... B65B 27/04 53/399
3,426,501 A 2/1969 Earp
3,509,684 A 5/1970 Hohl
3,742,677 A * 7/1973 Best ..... B65B 17/025 53/413
3,816,968 A * 6/1974 Morgan ..... B65D 5/061 53/556
3,946,535 A * 3/1976 Bourgeois ..... B65B 17/025 53/48.5
4,018,027 A * 4/1977 Curry ..... B65D 71/504 53/48.2
4,121,401 A * 10/1978 Duerr ..... B65B 17/025 53/49
4,250,682 A * 2/1981 Braun ..... B65B 17/025 53/556
4,354,334 A * 10/1982 Hara ..... B65B 17/025 53/556
5,054,257 A * 10/1991 Cunningham ..... B65B 61/06 83/326
5,671,588 A * 9/1997 Chan ..... B65B 17/025 53/398
6,122,893 A * 9/2000 Weaver ..... B65D 71/504 53/201
6,170,225 B1 * 1/2001 Cervantes ..... B65B 17/025 53/556
8,112,970 B2 * 2/2012 Marco ..... B65B 17/025 53/556
9,533,782 B2 * 1/2017 Slovik ..... B65B 57/00
11,834,241 B2 * 12/2023 Samaras ..... B65B 27/04
2004/0003573 A1 * 1/2004 Moore ..... B65B 17/025 53/544
2011/0005169 A1 * 1/2011 Ober ..... B65B 61/08 83/331
2024/0351718 A1 10/2024 Whitten et al.
2024/0351722 A1 10/2024 Whitten et al.

OTHER PUBLICATIONS

PCT Written Opinion of the International Searching Authority, Form PCT/ISA/237, for International Application PCT/US2024/025469, Aug. 1, 2024 (6 pages).

* cited by examiner

CUT-OFF SYSTEM FOR CONTAINER CARRIER APPLICATING MACHINE

CROSS REFERENCE TO RELATED APPLICATION

This application claims the benefit of U.S. Provisional Application Ser. No. 63/460,496, filed on 19 Apr. 2023. The co-pending provisional application is hereby incorporated by reference herein in its entirety and is made a part hereof, including but not limited to those portions which specifically appear hereinafter.

BACKGROUND OF THE INVENTION

Field of the Invention

This invention relates generally to a system, method, and apparatus for applying container carriers to a plurality of containers to create beverage multipacks.

Description of Prior Art

Conventional container carriers are often used to unitize a plurality of similarly sized containers, such as cans, bottles, jars and boxes and/or similar containers that require unitization. Flexible plastic ring carriers and paperboard boxes are two such conventional container carriers.

However, with growing concerns surrounding the environmental impact of improper disposal of plastic waste, manufacturers are transitioning offerings to best support a circular economy. One such solution is plastic ring carriers made from 50% post-consumer recycled content. This carrier is operationally efficient, competitively priced, simple, and has a low carbon footprint in comparison to other beverage multipack alternatives. Today, this flexible solution is not considered 100% curbside recyclable by the FTC Green Guide because 60%+ consumers cannot recycle flexible plastics.

Multi-packaging systems are generally used in the beer, soft drink, and general products industries. A new and innovative beverage multipackaging solution is desirable that includes a 4, 6, 8, and/or 12 beverage capacity. A preferred design is produced using 100% curbside recyclable rigid plastics, like HDPE or PET. These carriers would be applied on PET bottles and/or aluminum cans.

However, application technology for such generally rigid carriers lags well behind traditional application systems that can accommodate thousands of containers per minute. Current technology often requires cumbersome hand application or slow systems that cannot handle high volumes at sufficiently high speeds.

SUMMARY OF THE INVENTION

The invention generally relates to a system, method and apparatus for applying container carrier to a plurality of containers to form a multipack.

A preferred embodiment utilizes container carriers made from materials that are 100% curbside recyclable, in particular generally rigid PET and HDPE plastics, that can enter most municipal recycling streams. Traditionally, these carriers have been applied by hand or in slow inefficient processes.

A method, system and apparatus is therefore desired that quickly and efficiently affixes a generally rigid container carrier to a plurality of containers.

Other objects and advantages will be apparent to those skilled in the art from the following detailed description taken in conjunction with the appended claims and drawings.

DETAILED DESCRIPTION OF THE INVENTION

Figure 1:
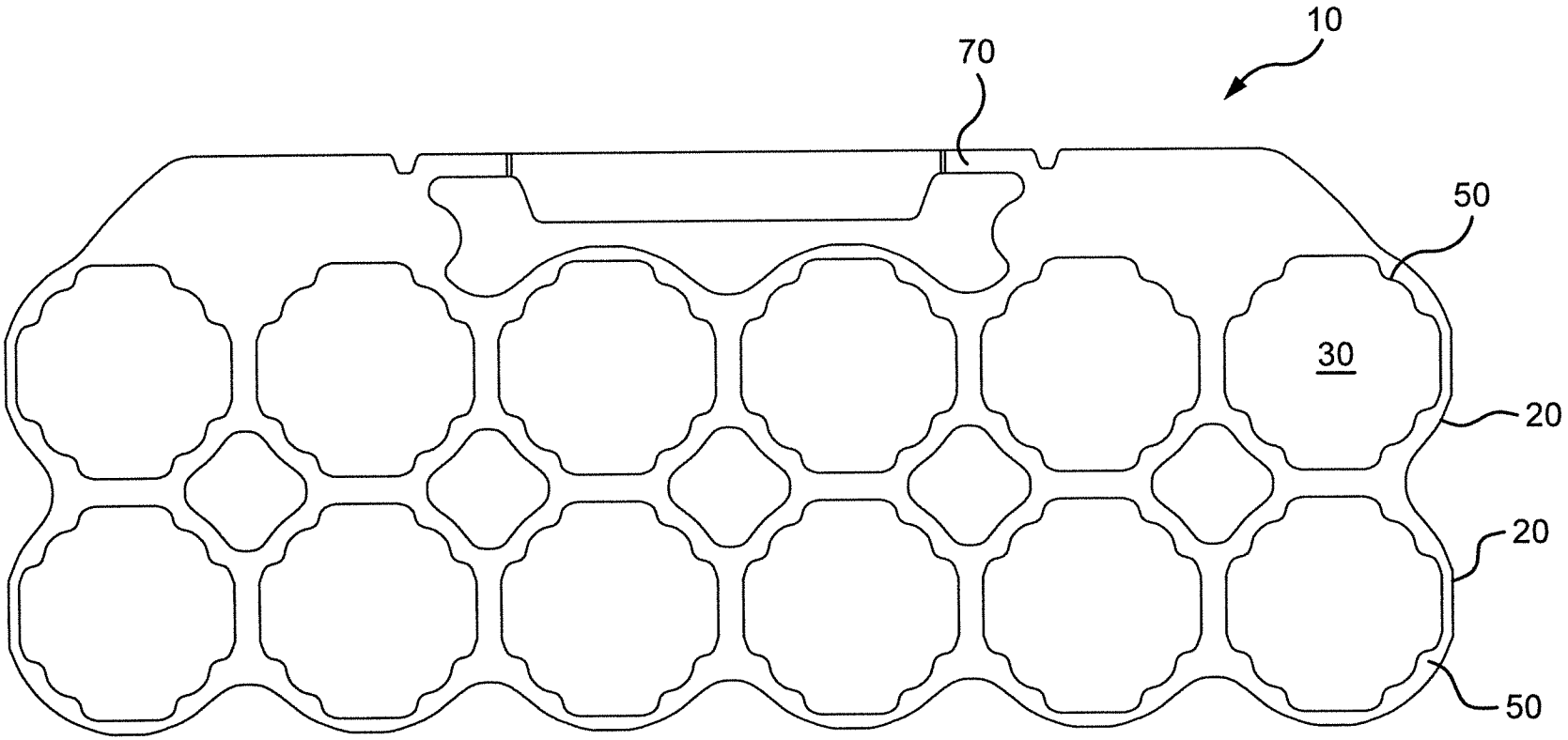
FIG. 1 shows a top plan view of a container carrier for unitizing twelve containers according to one embodiment.
Figure 2:
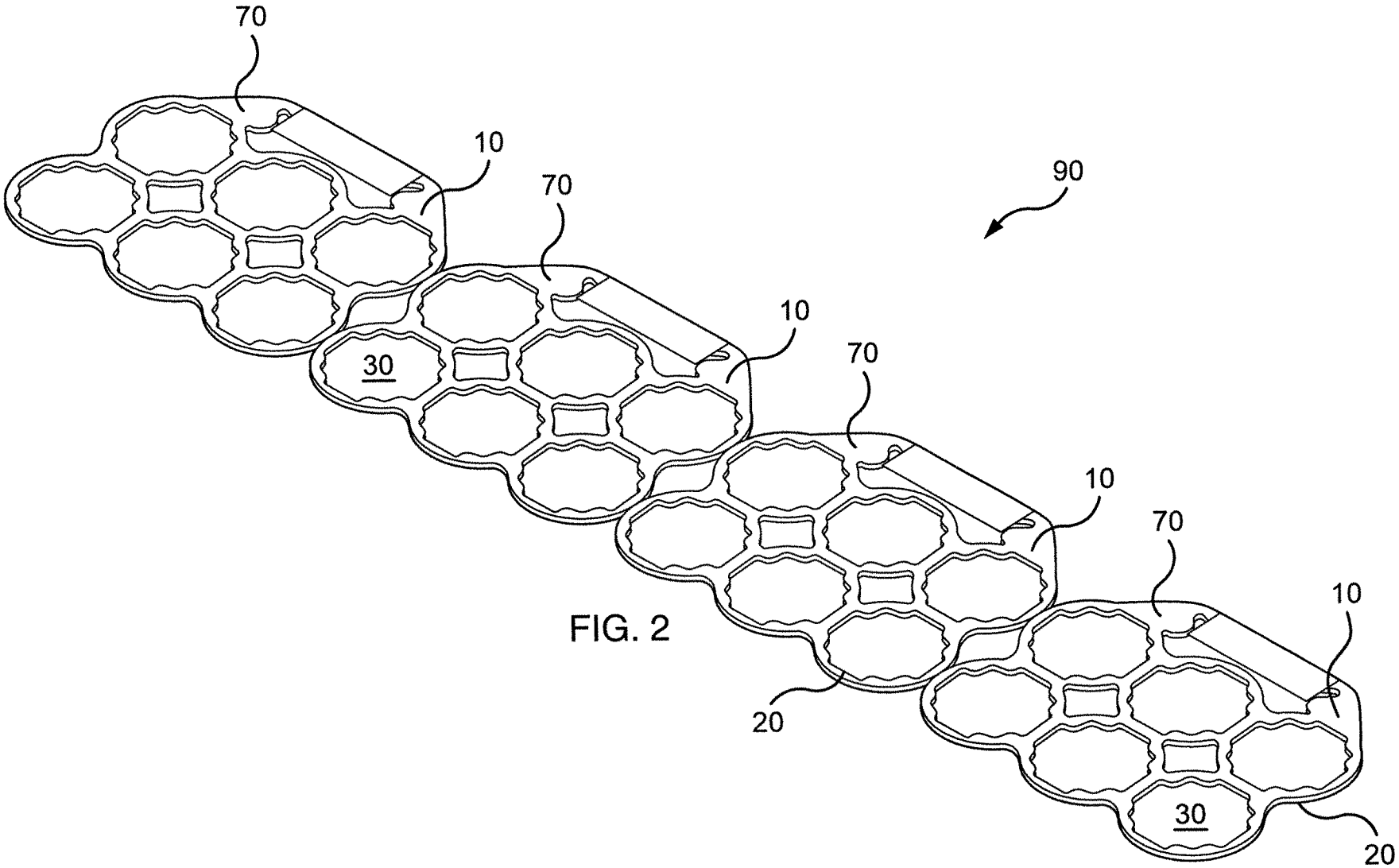
FIG. 2 shows a front perspective view of a stick of container carriers, each container carrier for unitizing six containers according to one embodiment.
Figure 3:
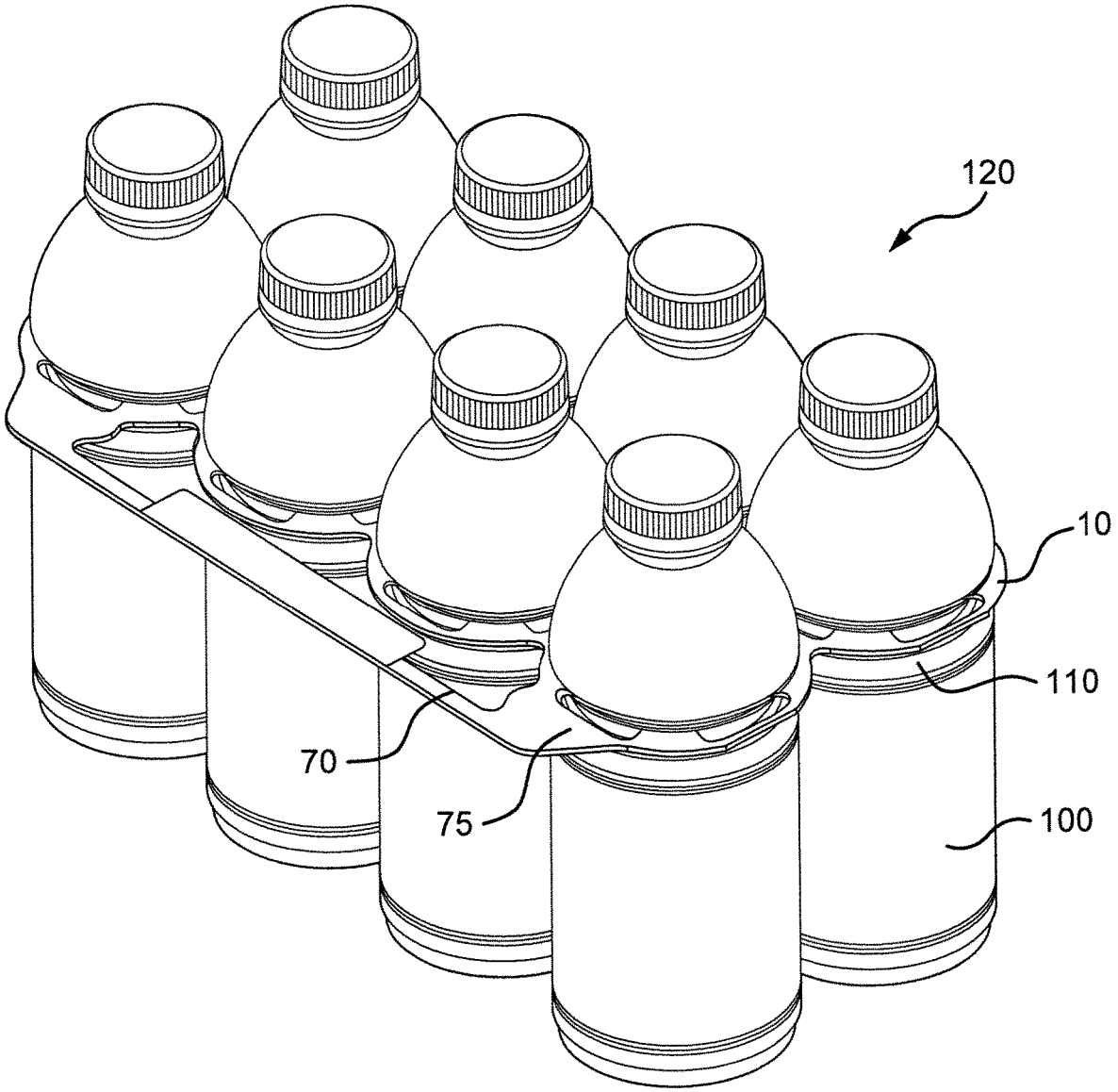
FIG. 3 shows a package of eight containers according to one embodiment.

The present invention provides a system, apparatus and method for applying a container carrier to unitize a plurality of containers into beverage multipacks. Container carriers and various unitized packages of containers according to various embodiments are shown in FIGS. 1-3. The remaining figures show various embodiments of the subject system and apparatus for applying container carriers. Although the container carrier 10 and package 120 shown in FIGS. 1-3 are representative of the type that may be used in connection with the subject system, the subject system may be used in connection with any number of styles of container carrier 10 and desirably meet the same objectives.

According to a preferred embodiment of this invention, the container carrier 10 shown in FIGS. 1-3 is injection molded or otherwise formed from high density polyethylene (HDPE). Alternatively, PET or HDPE plastics may be used. Preferably, the material is generally rigid and 100% post-consumer recyclable in most or all markets.

Once manufactured, the container carrier 10 may be applied to groups of containers 100 to make completed unitized multipacks or packages 120. It is contemplated that 4 packs, 6 packs, 8 packs, 10 packs and 12 packs may be unitized without departing from the essential features of this invention.

In a preferred embodiment of this invention, the container carrier 10 includes a network of molded ribs 20 forming a plurality of container receiving openings 30 corresponding with a desired size of multipack. As such, FIG. 1 shows twelve container receiving openings in a 2×6 array, other desired container carriers may be 2×2 for a four pack, 2×4 for an eight pack, such as shown in FIG. 3, 2×3 for a six pack, such as shown in FIG. 2, or other desired arrays forming a desirable quantity multipack size.

As shown for example in FIG. 2, a stick 90 of adjacent container carriers 10 for unitizing a plurality of containers include a network of molded ribs 20 forming a plurality, in this case six, container receiving openings 30. An arrangement of inwardly extending tabs 50 are formed in each container receiving opening 30 toward a center of each container receiving opening 30.

Each tab 50 of the arrangement of tabs 50 are engageable with a circumferential groove 110 in a corresponding container 100 of the plurality of containers 100 to form the package shown in FIG. 3. A handle 70 is preferably formed along one edge of the container carrier 10. The handle 70 may be grasped by the consumer to form a comfortable, compact, tightly unitized plurality of containers 100 within the package 120.

In a preferred embodiment, a hinge 75 is formed between the handle 70 and the one edge of the container carrier 10. The hinge 75 may be formed with a reduced thickness of material between the one edge of the container carrier 10 and the handle 70. In such an arrangement, the handle 70 may be urged downward after application to permit a more compact package 120 without undue interference from an outwardly extending handle 70.

As shown in FIG. 2, the container carrier 10 may be grouped in segments or "sticks" 90 of two to six container carriers 10 connected in a unitized stick 90. Such sticks 90 may or may not include frangible connection points between adjacent container carriers 10. According to a preferred embodiment, these groups of container carriers 10 are molded into sticks 90 or segments of two or more container carriers 10. Such sticks 90 are preferably placed into stacked carts that may be assembled in a staging area for application. Each stack of containers is preferably shuttled to a magazine 85 at an inlet of the applicating machine 140. The magazine 85 may be loaded with a continuously operating shuttle system. Alternatively, the magazine 85 may be loaded with a loading robot comprising a robotic arm that sequentially loads new carts of carriers into the magazine as each previous magazine 85 is depleted. Individual groups of container carriers 10 may be collected in stacks using rods that travel through a vertical stack of carriers 10 and/or sticks 90.

Figure 4:
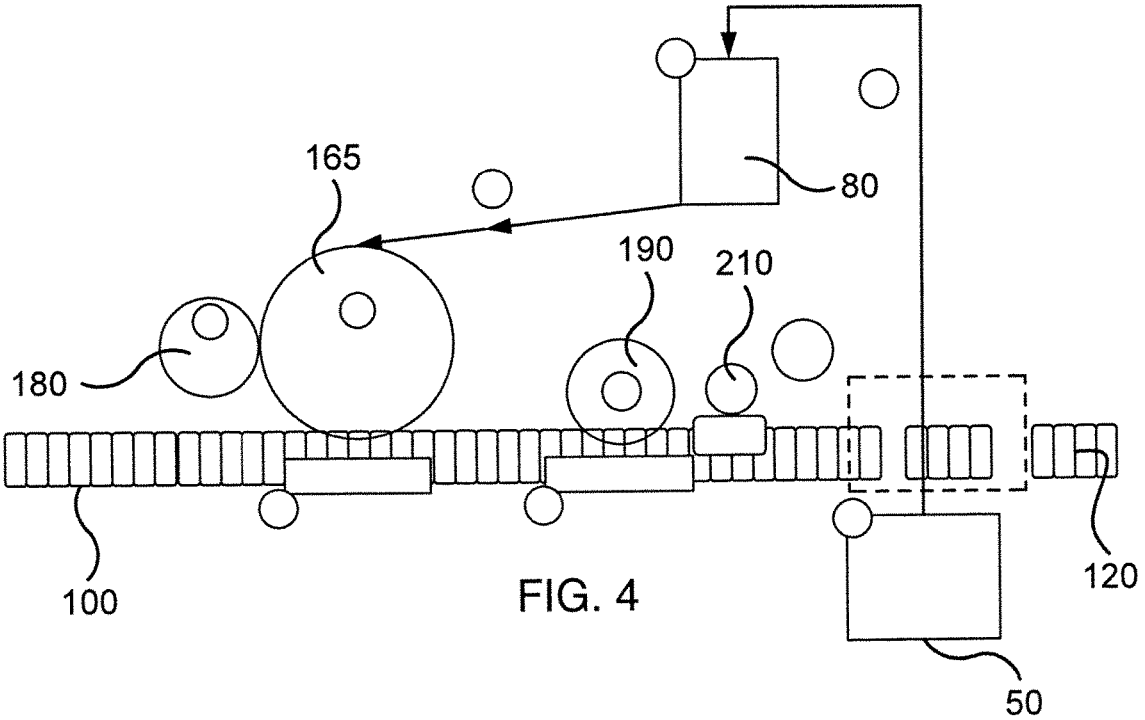
FIG. 4 shows a schematic of the subject system according to one embodiment.
Figure 5:
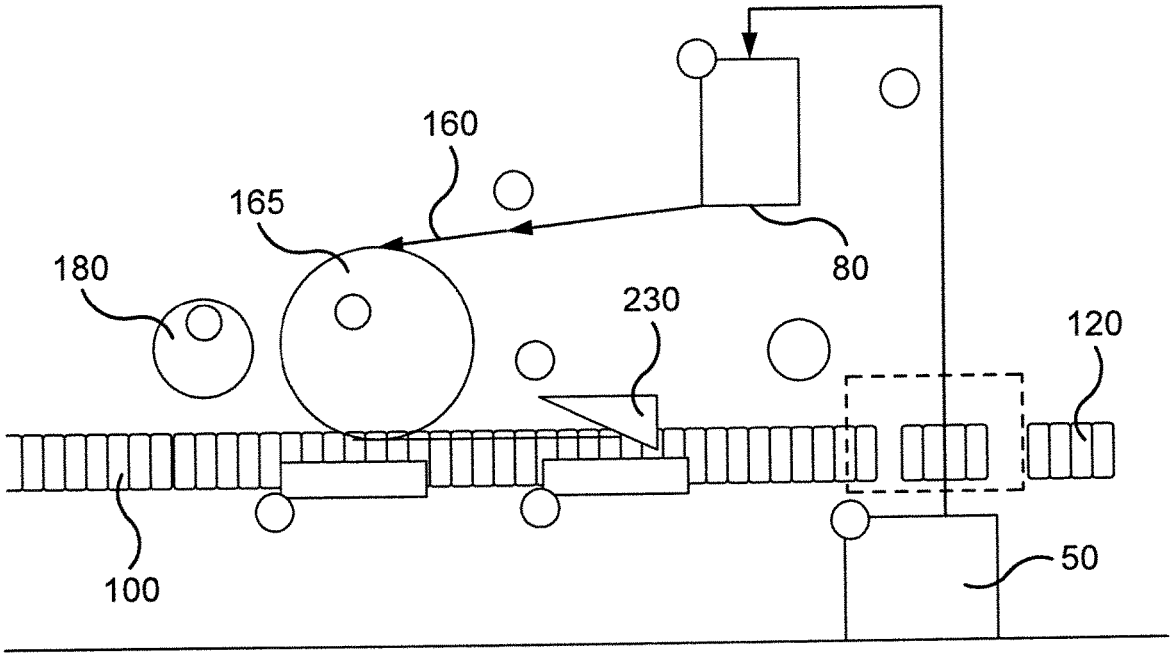
FIG. 5 shows a schematic of the subject system according to one embodiment.

FIGS. 4 and 5 show schematic overviews of the subject system which includes a feed section, an application section and a cutoff section. As shown schematically, the feed section includes a supply of container carriers 10 which are then applied to containers and the subsequent packages 120 of unitized containers 100 exit from the system preferably on a same side of the system as the supply of container carriers 10.

Figure 6:
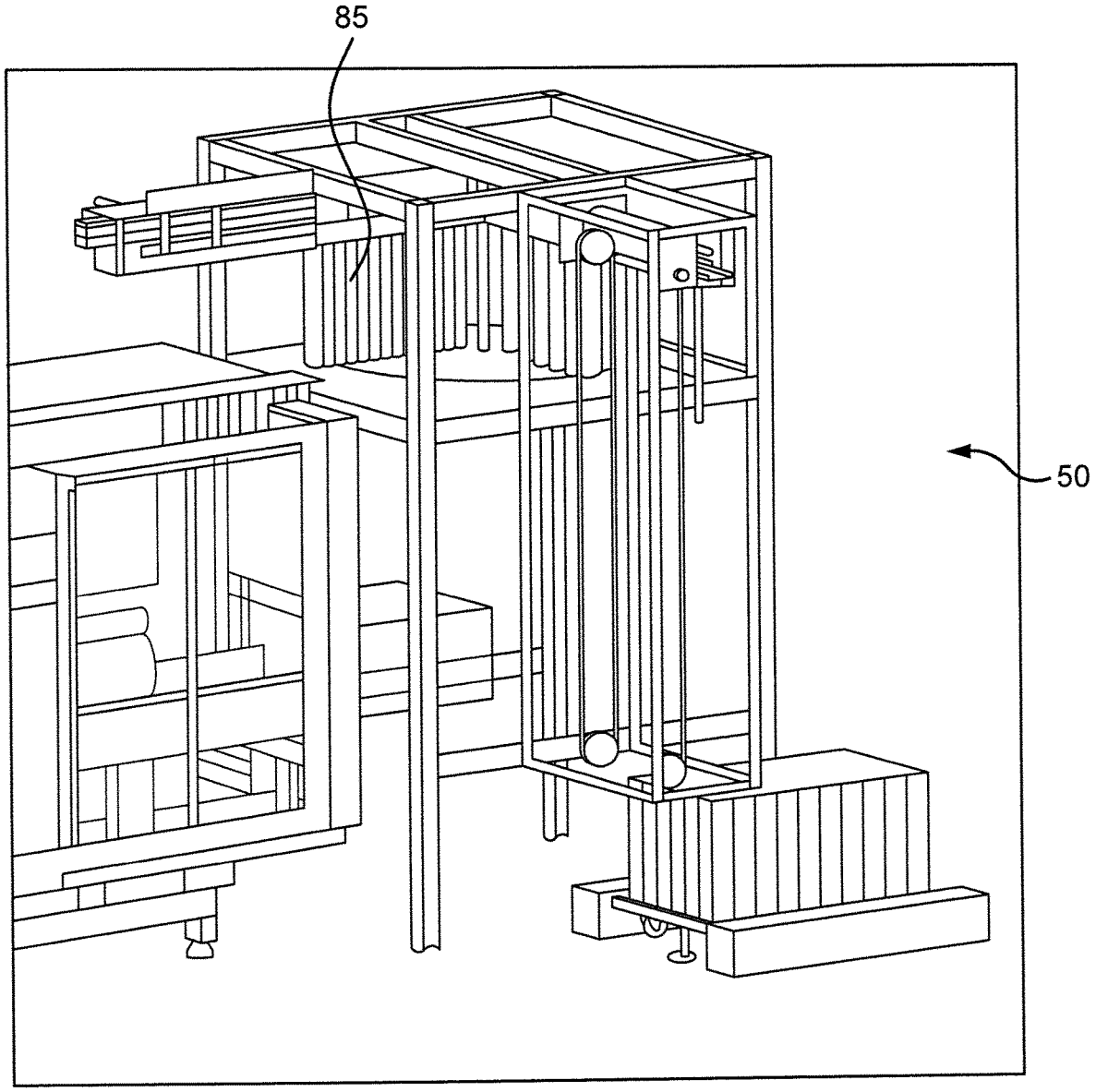
FIG. 6 shows a perspective view of a staging portion of the system according to one embodiment.
Figure 7B:
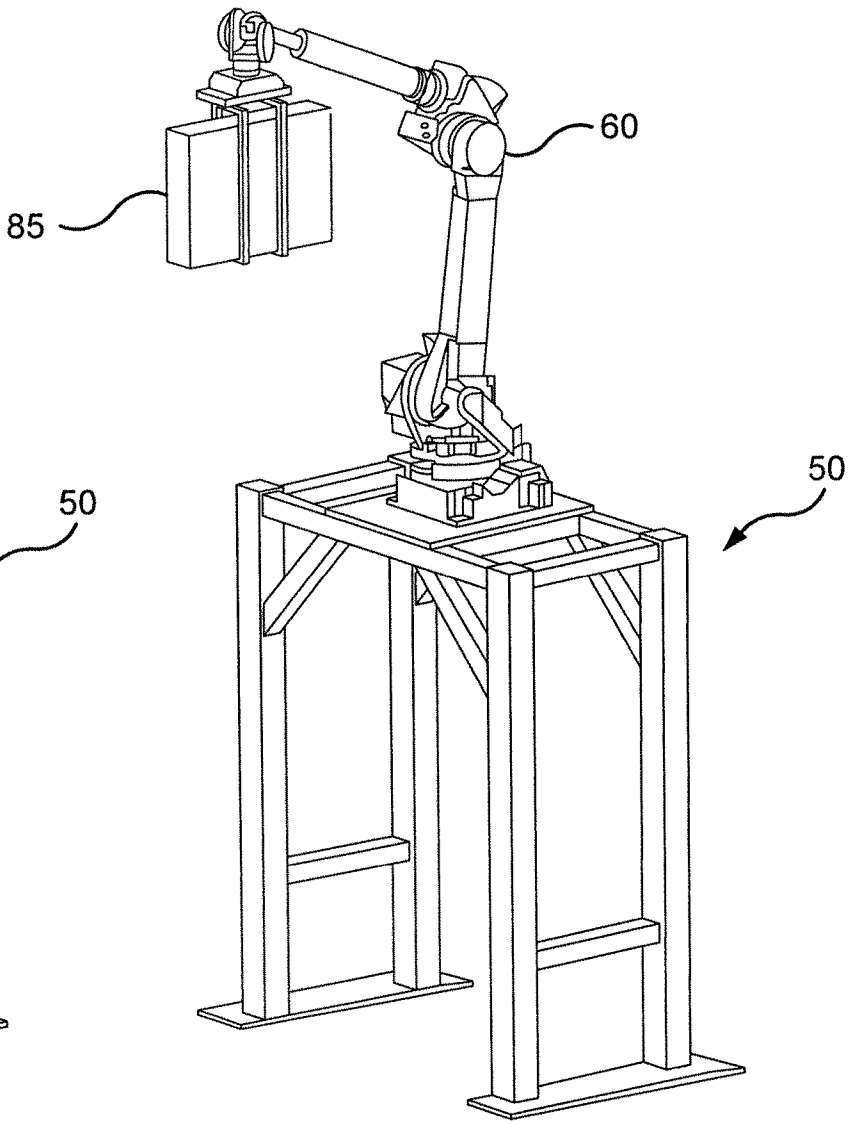
FIG. 7B shows a perspective view of the robotic arm of FIG. 7A positioning the stack of carriers from the staging portion of the system to the feeding portion of the system.
Figure 7A:
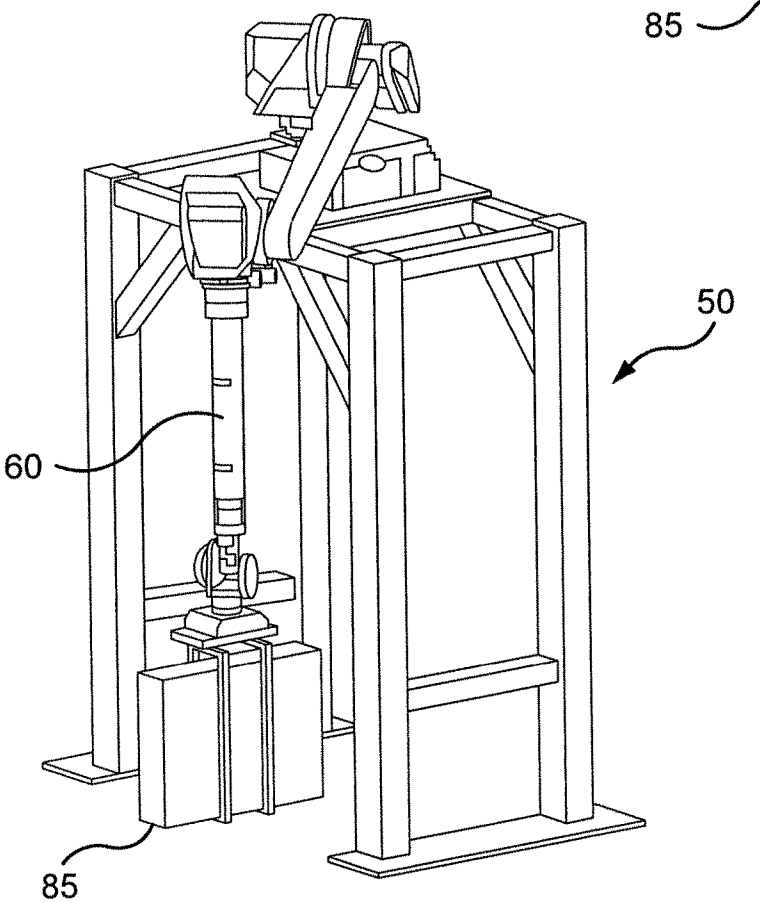
FIG. 7A shows a perspective view of a robotic arm grasping a stack of carriers from the staging portion of the system.

FIG. 6 shows a staging apparatus 50 of the subject system wherein stacks of container carriers 10 are maintained in a ready state for application to containers. The stacks of container carriers 10 are preferably staged in magazines 85. FIG. 7A shows a perspective view of a robotic arm 60 grasping a magazine 85 of carriers from the staging portion of the system. FIG. 7B shows a perspective view of the robotic arm 60 of FIG. 7A positioning the magazine 85 of carriers from the staging portion of the system to the feeding portion of the system.

Figure 8:
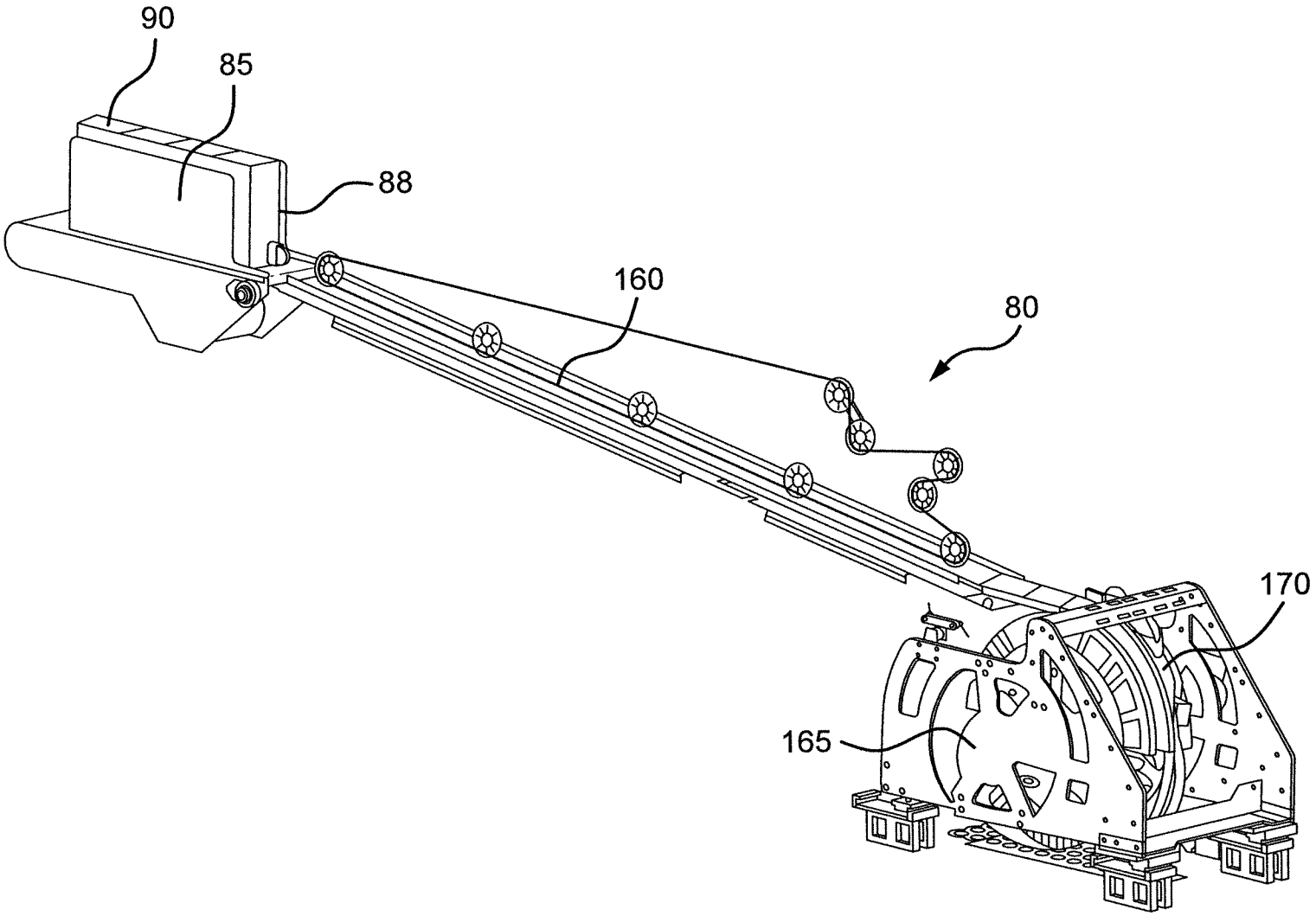
FIG. 8 shows a perspective view of a feed portion of the system according to one embodiment.
Figure 9:
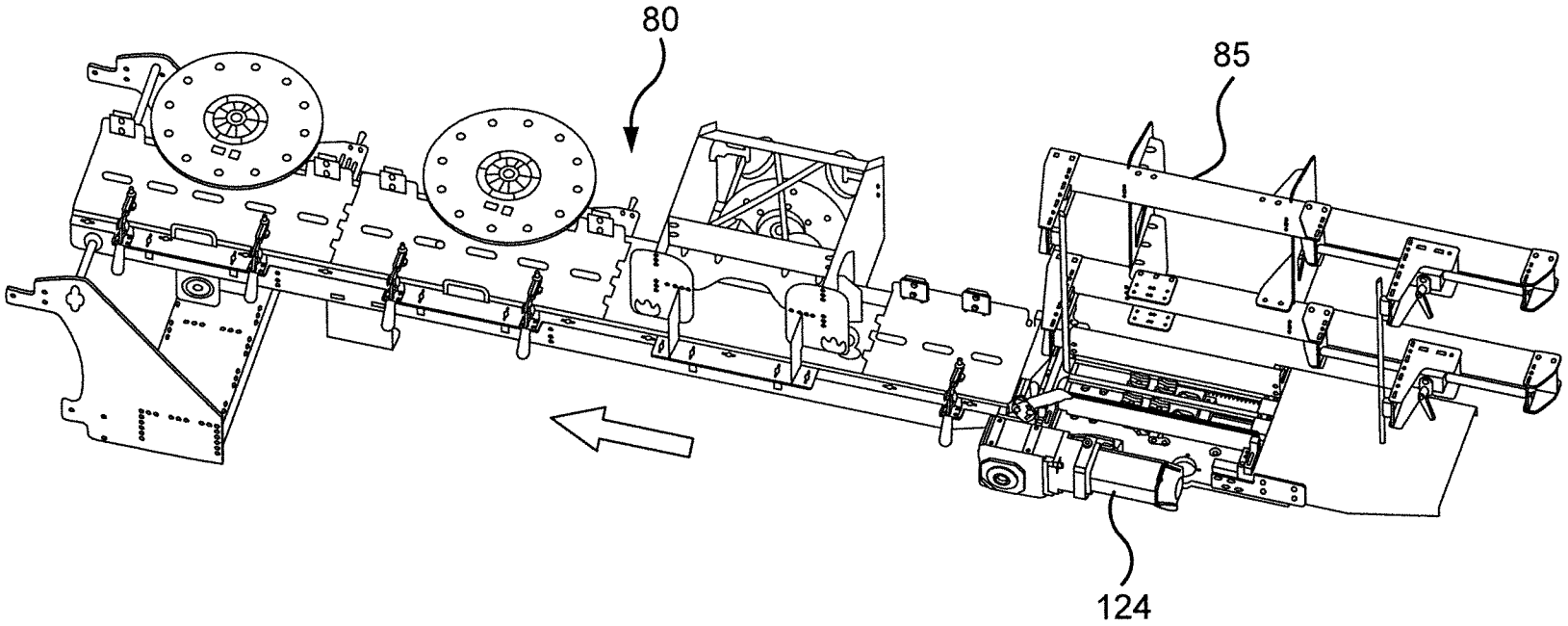
FIG. 9 shows a perspective view of a feed portion of the system according to one embodiment.
Figure 10:
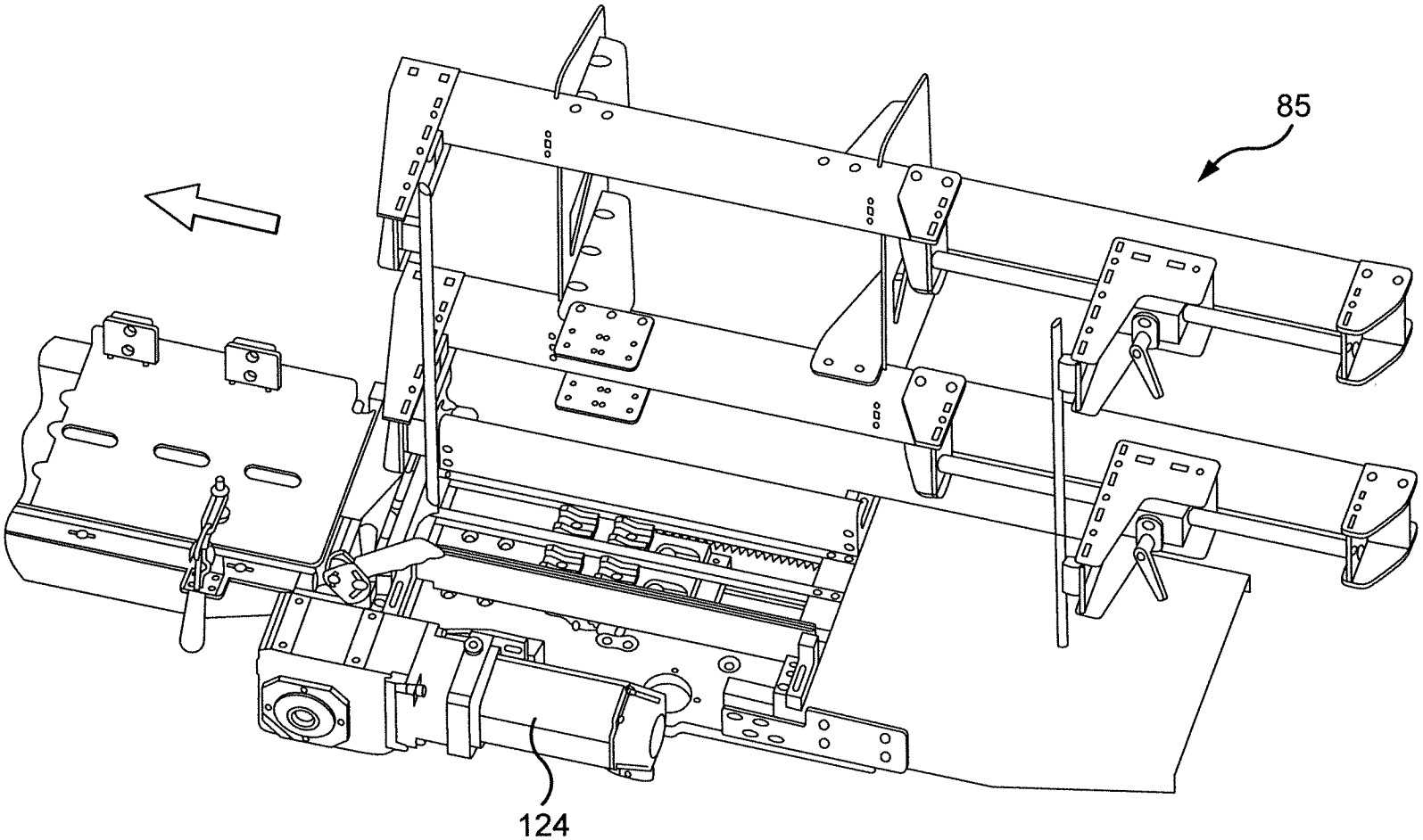
FIG. 10 shows a detailed perspective view of the feed portion of the system shown in FIG. 9.
Figure 11:
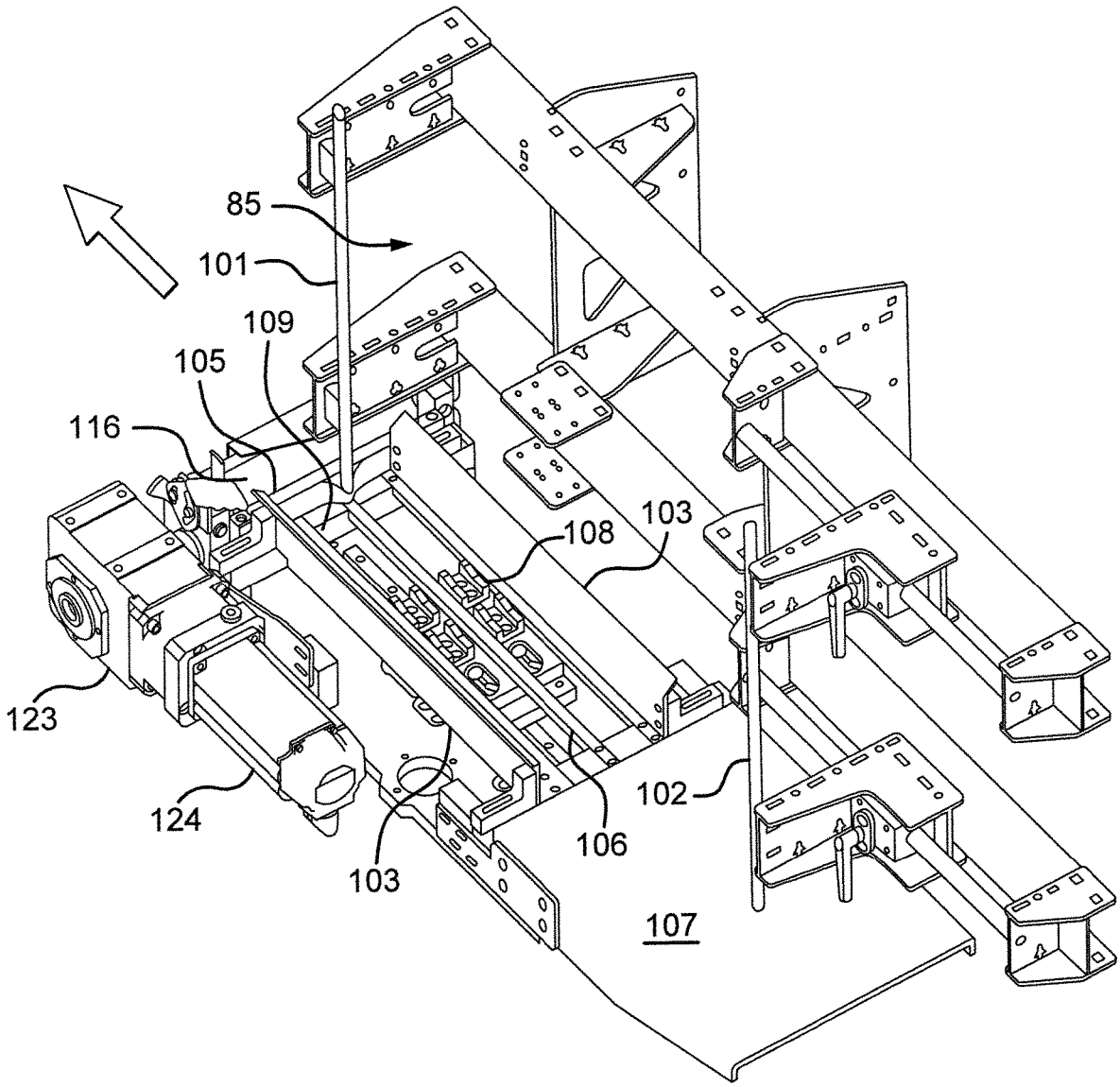
FIG. 11 shows a perspective view of a feed portion of the system according to one embodiment.
Figure 12:
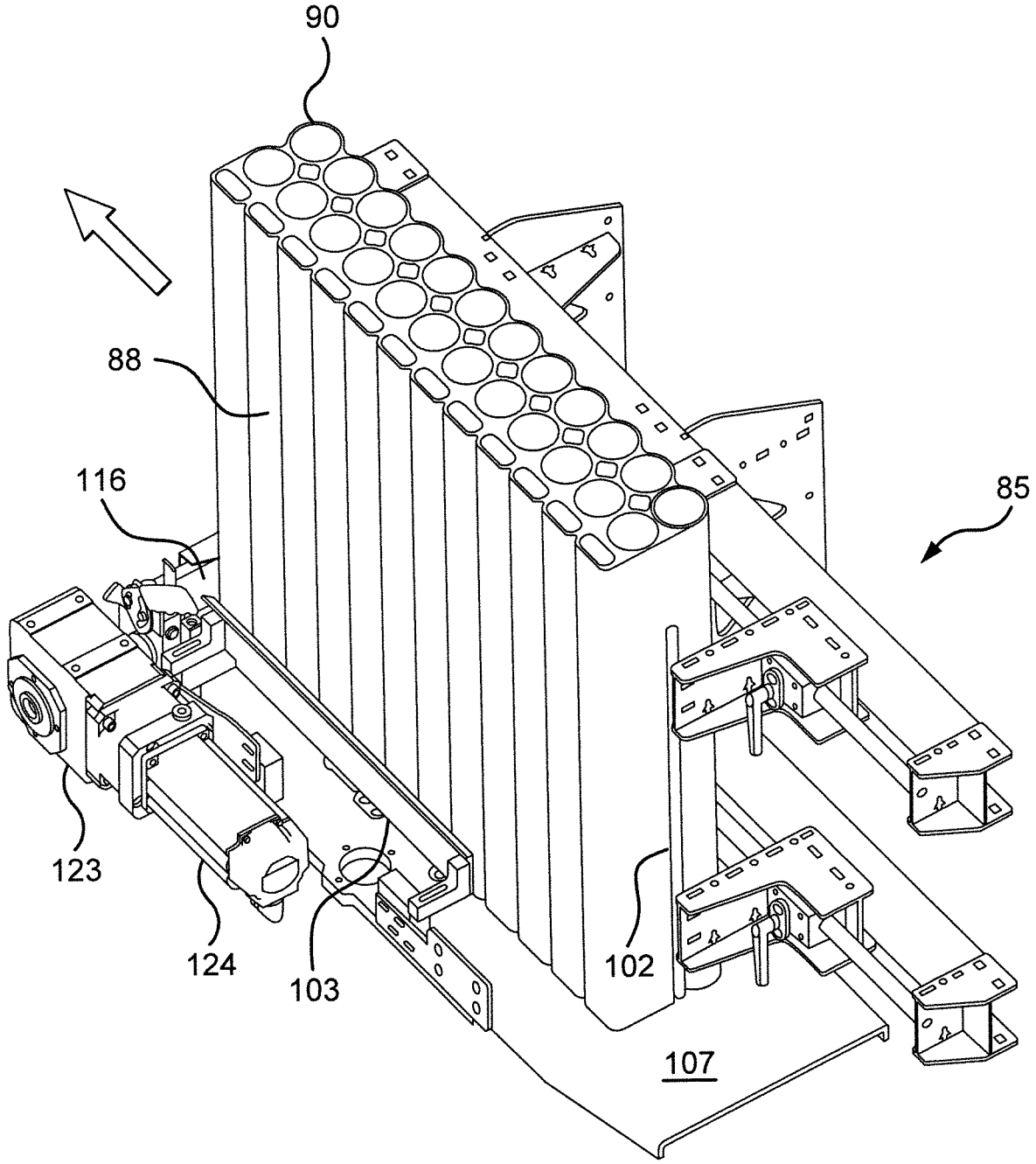
FIG. 12 shows a perspective view of the feed portion of the system shown in FIG. 11 loaded with container carriers.
Figure 13:
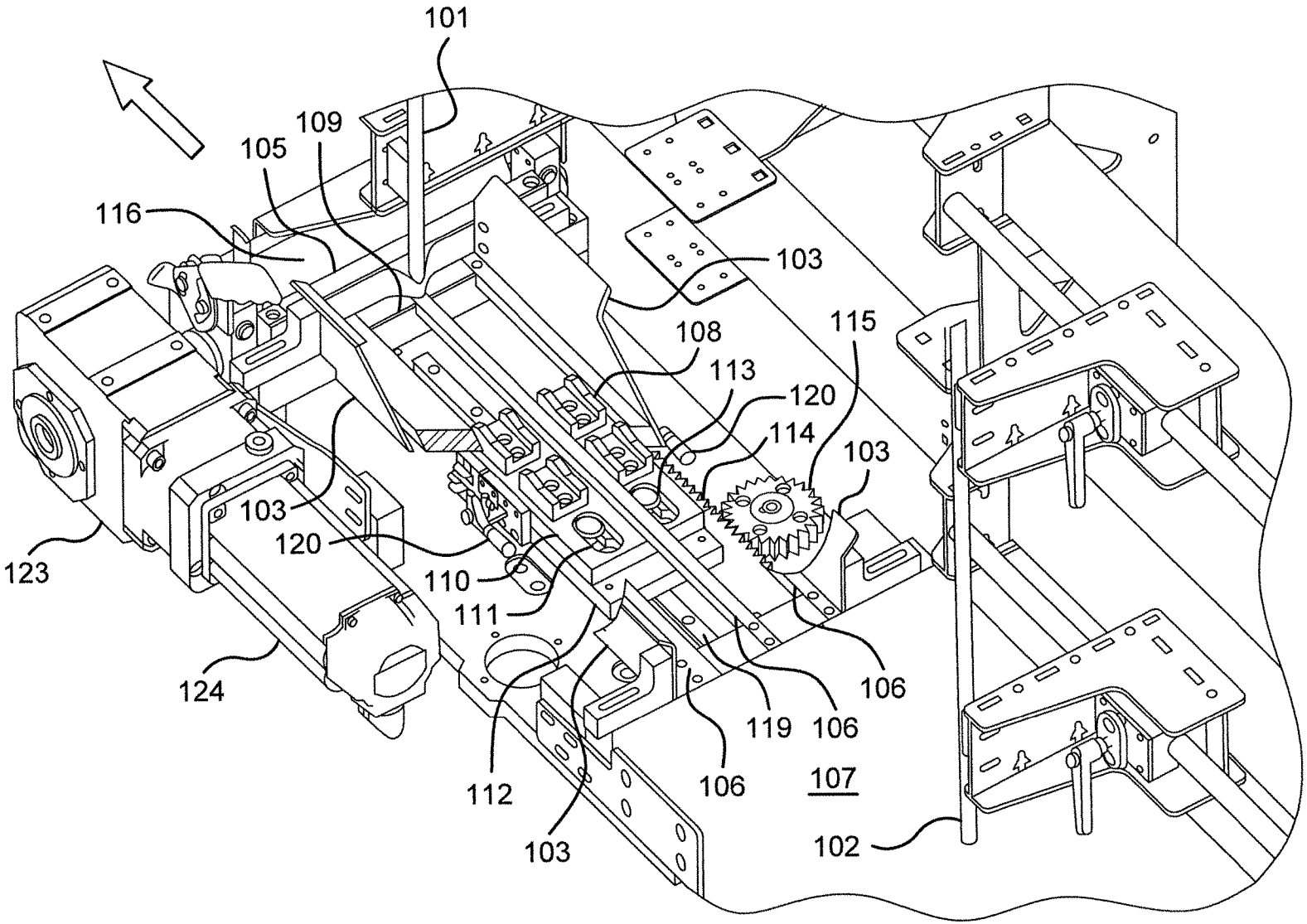
FIG. 13 shows a perspective view of a feed portion of the system according to one embodiment.
Figure 14:
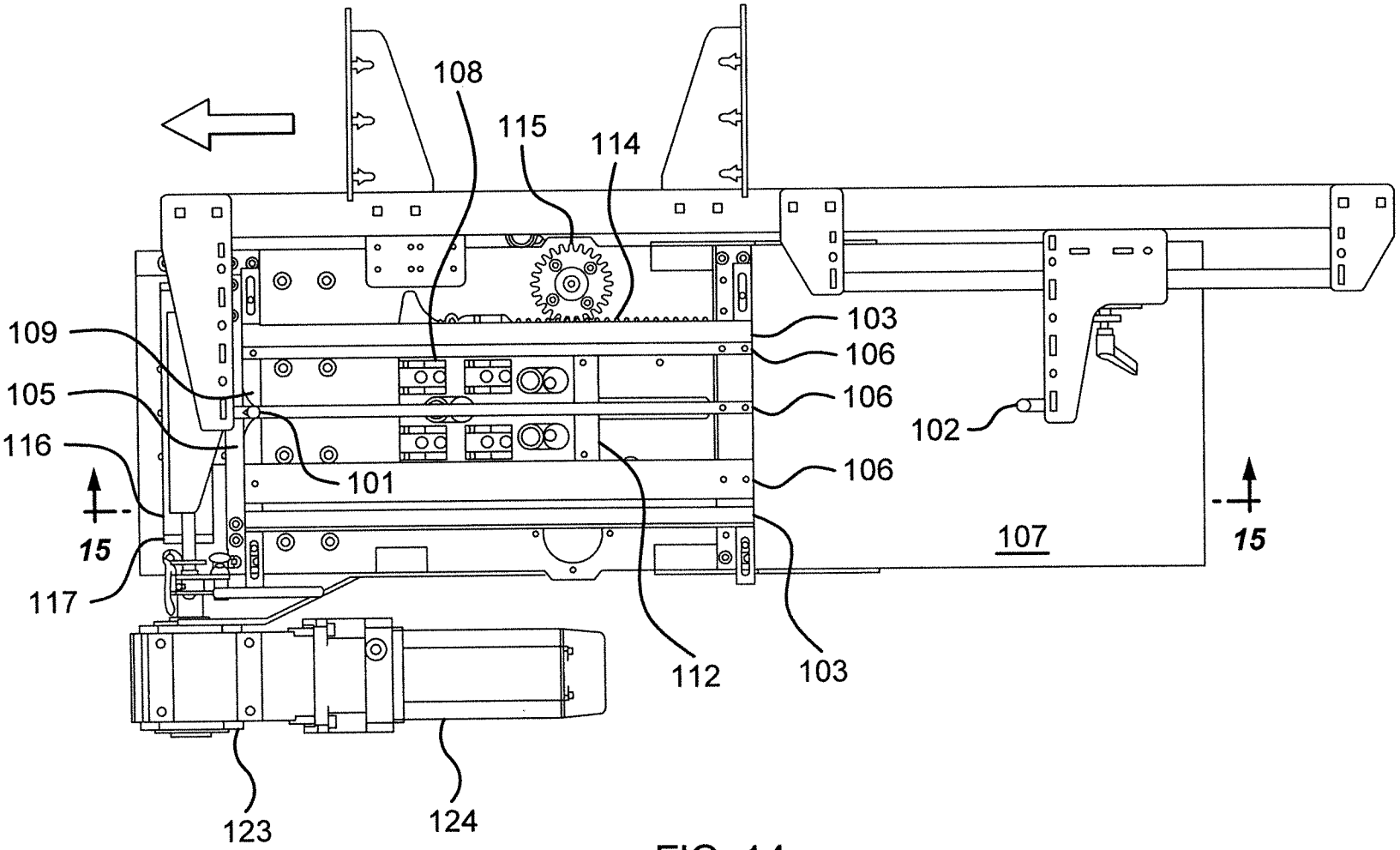
FIG. 14 shows a top view of a feed portion of the system according to one embodiment.
Figure 15:
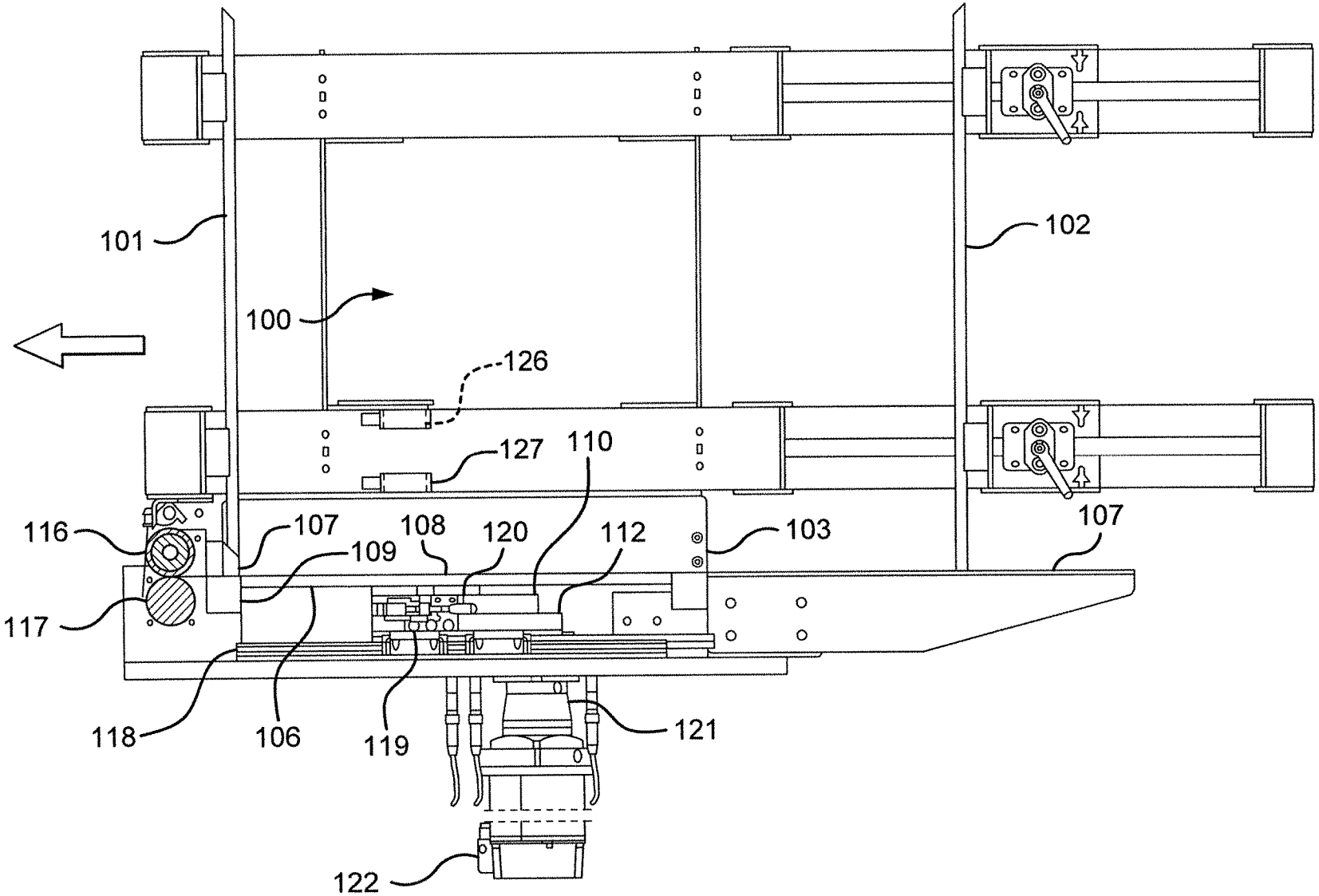
FIG. 15 shows a top view of a feed portion of the system according to one embodiment taken along Section 15-15 of FIG. 14.
Figure 16:
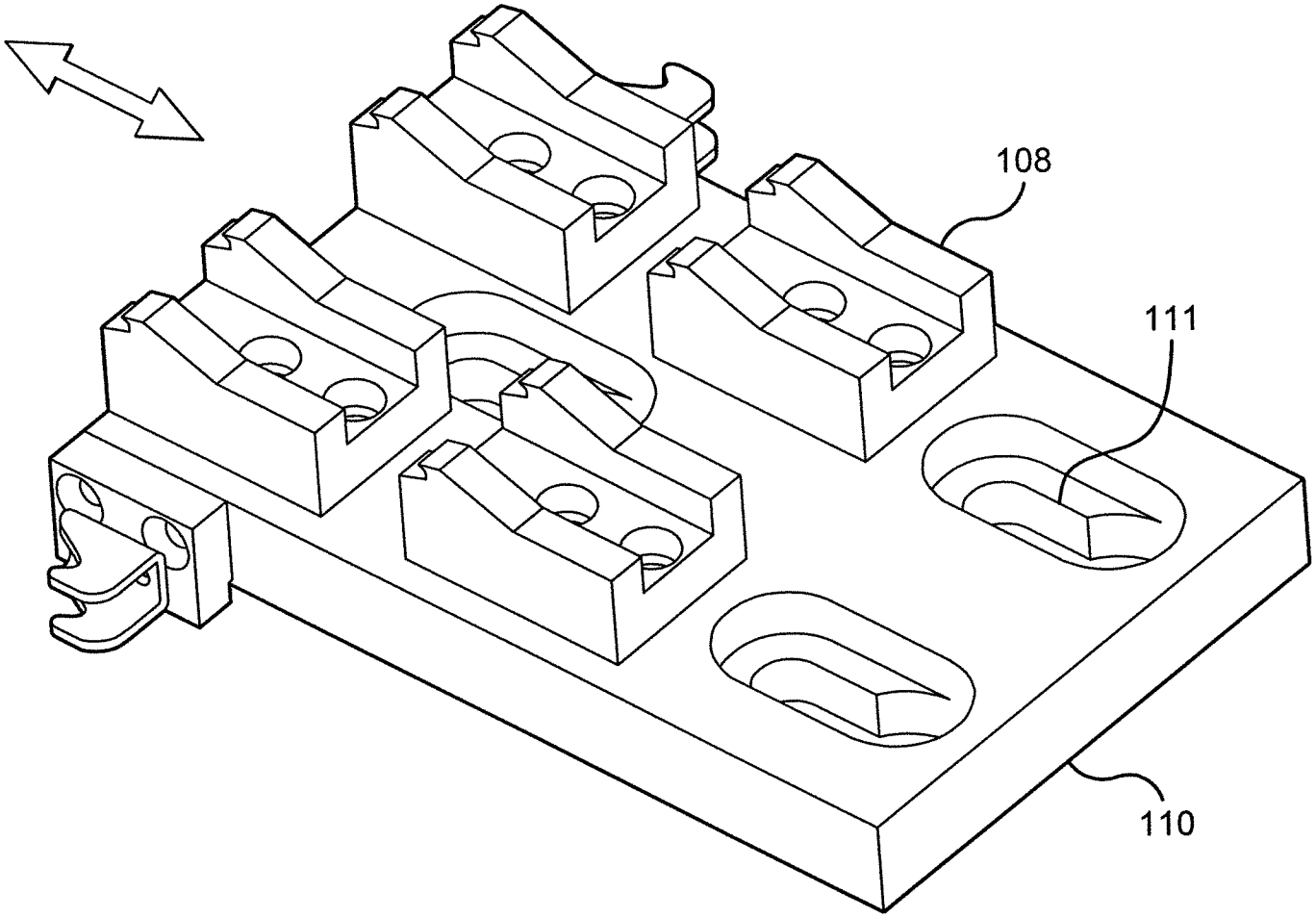
FIG. 16 shows a perspective view of a feed portion of the system according to one embodiment.
Figure 17:
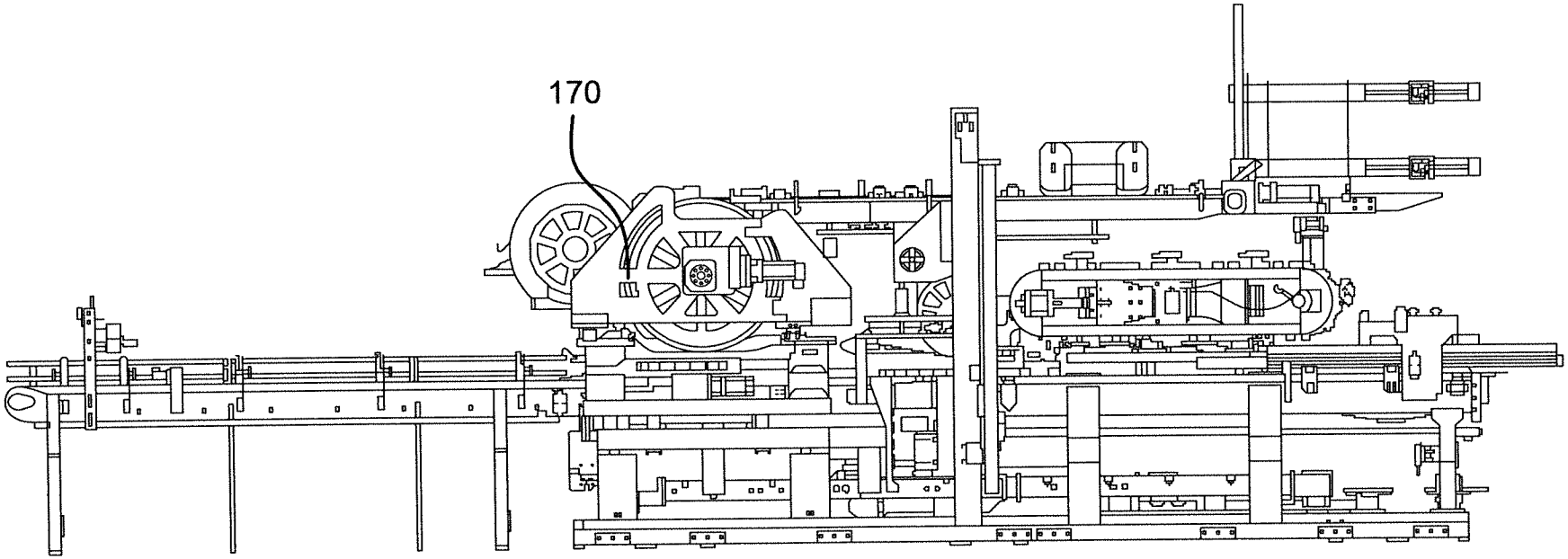
FIG. 17 shows a side view an applicating machine according to one embodiment.
Figure 18:
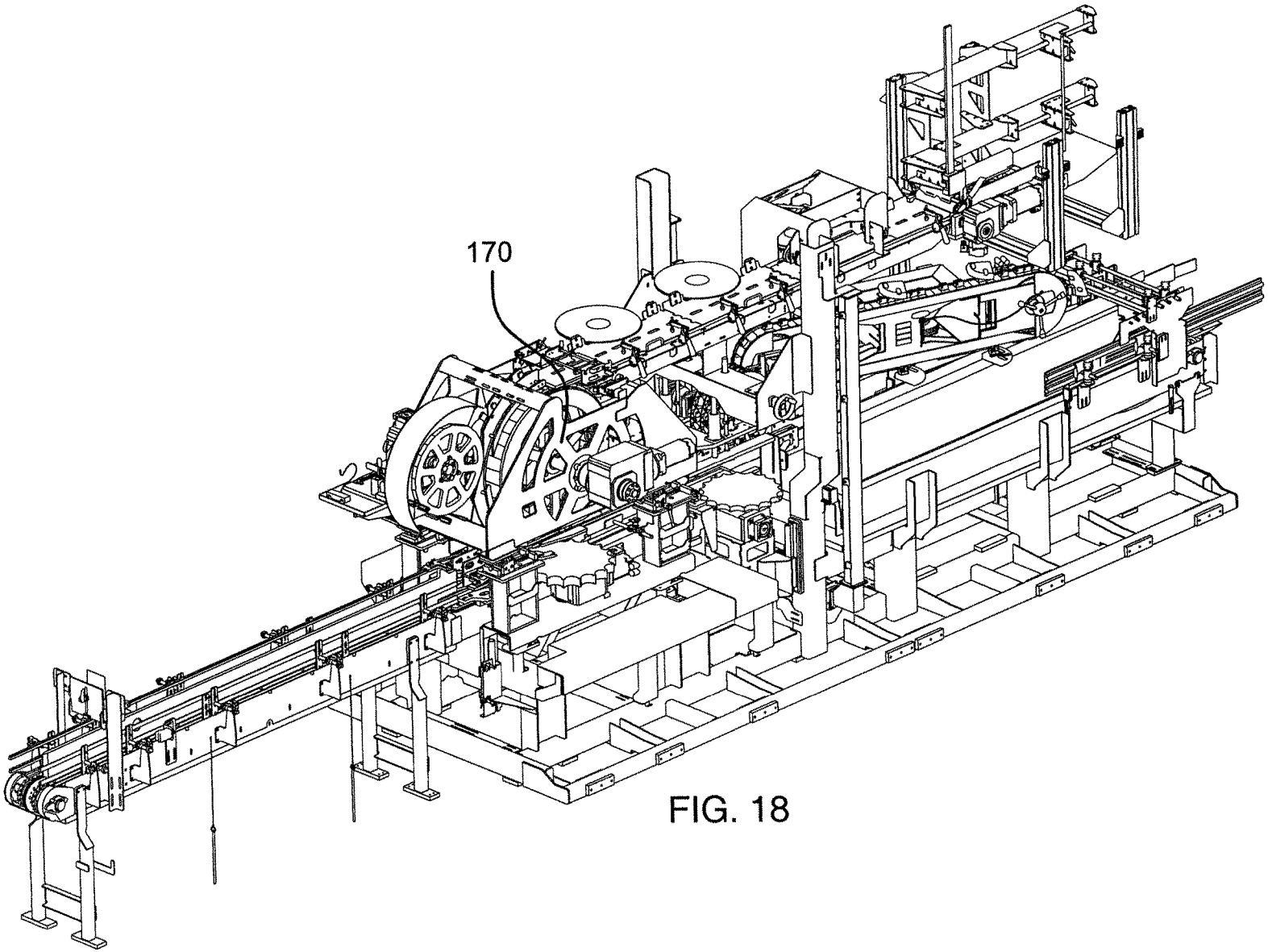
FIG. 18 shows a front perspective view of the applicating machine shown in FIG. 17.
Figure 19:
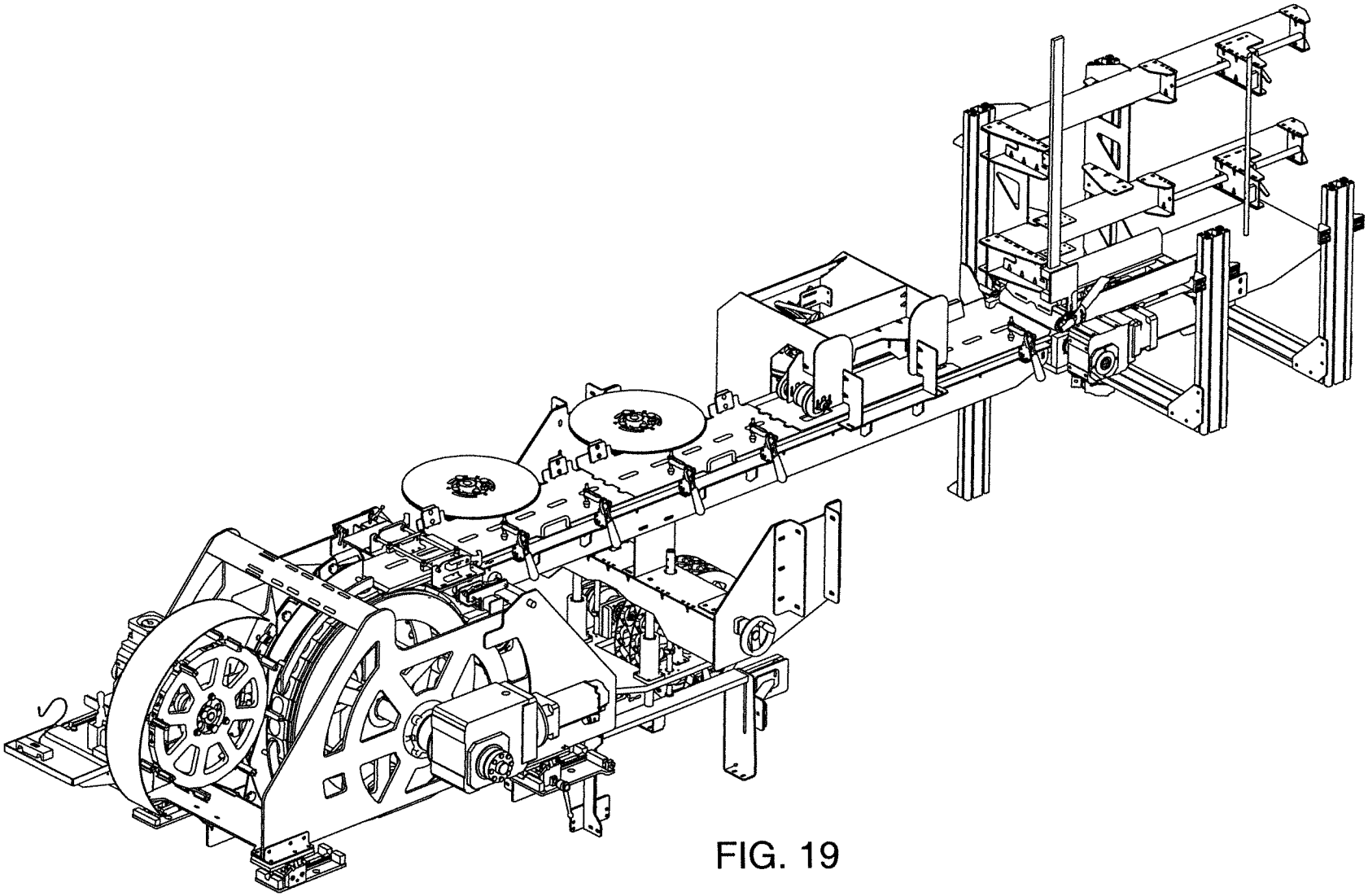
FIG. 19 shows a front perspective view of a portion of the applicating machine shown in FIG. 17.
Figure 20:
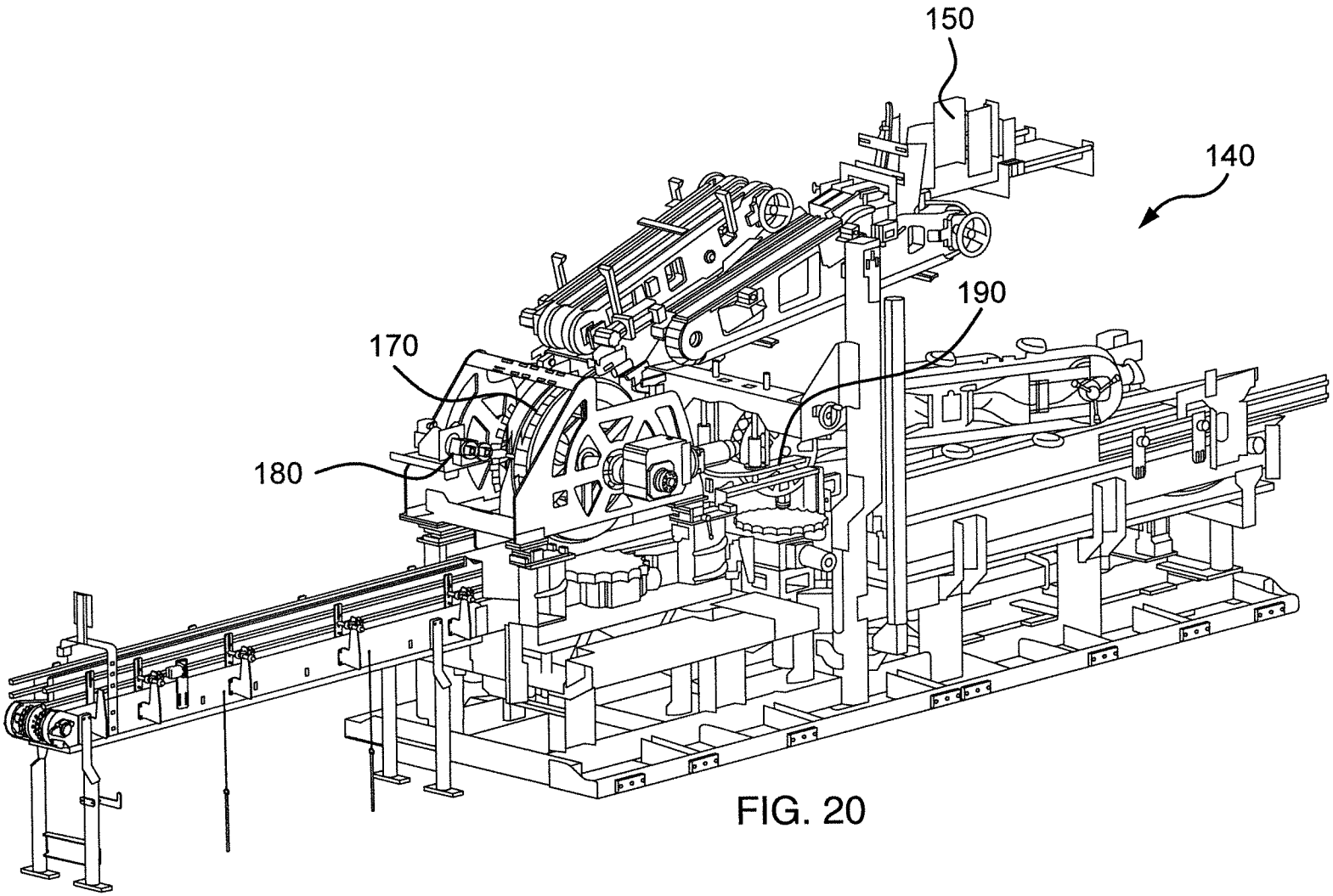
FIG. 20 shows a front perspective view of an applicating machine according to one embodiment.
Figure 21:
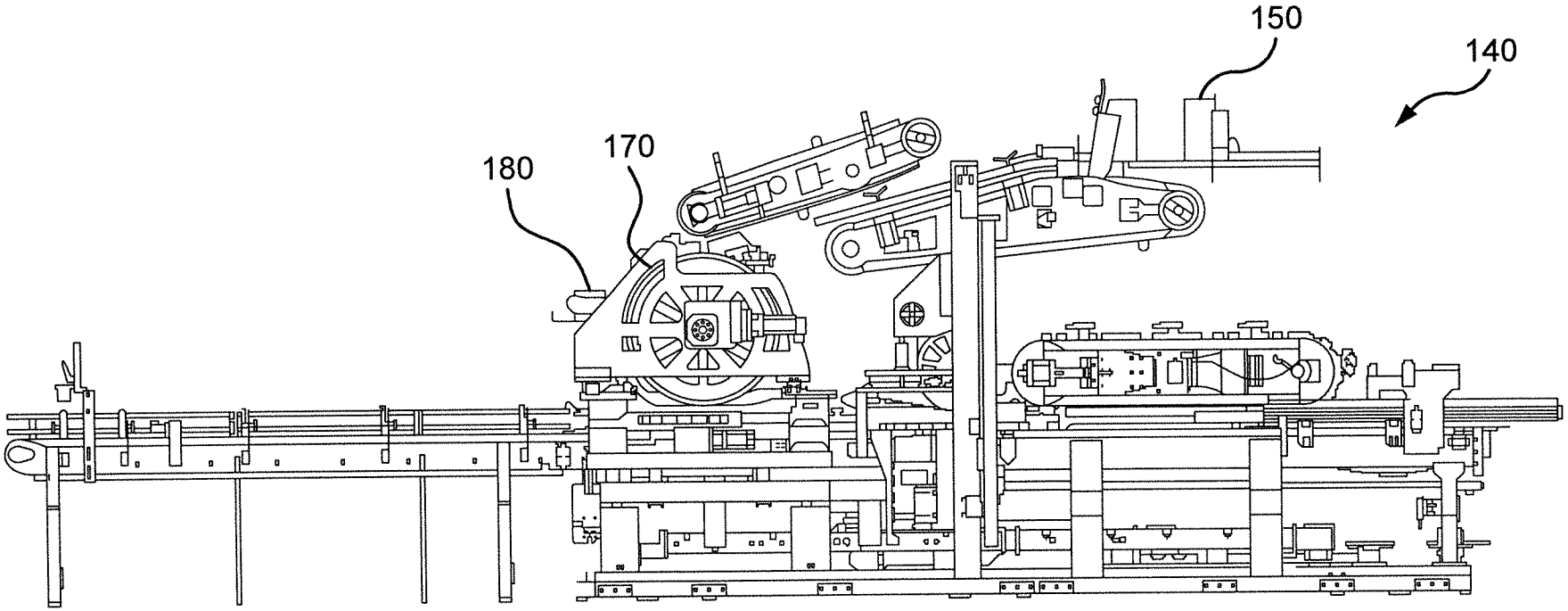
FIG. 21 shows a side view of the applicating machine shown in FIG. 20.
Figure 22:
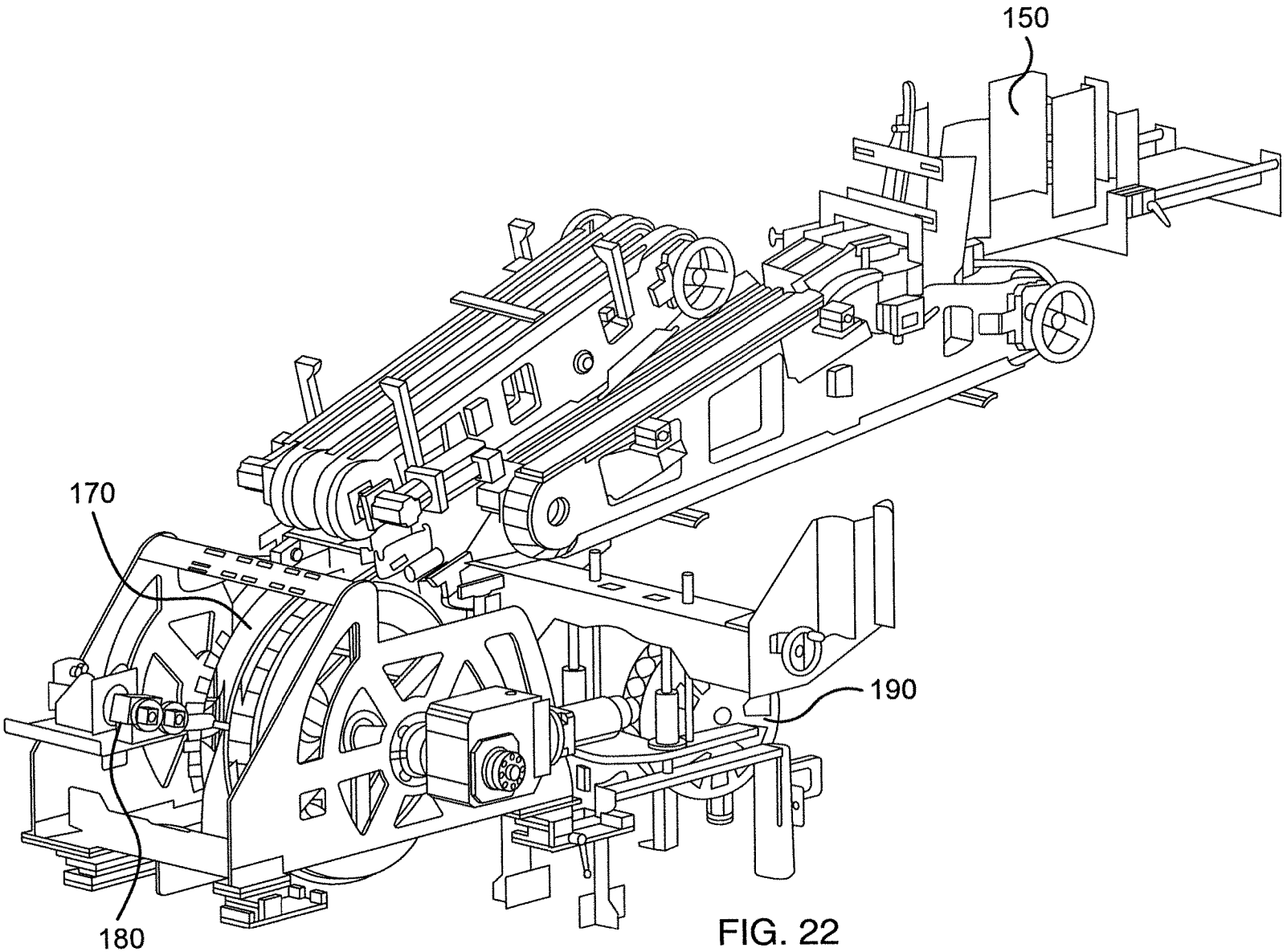
FIG. 22 shows a front perspective view of a portion of the applicating machine shown in FIG. 20.
Figure 23:
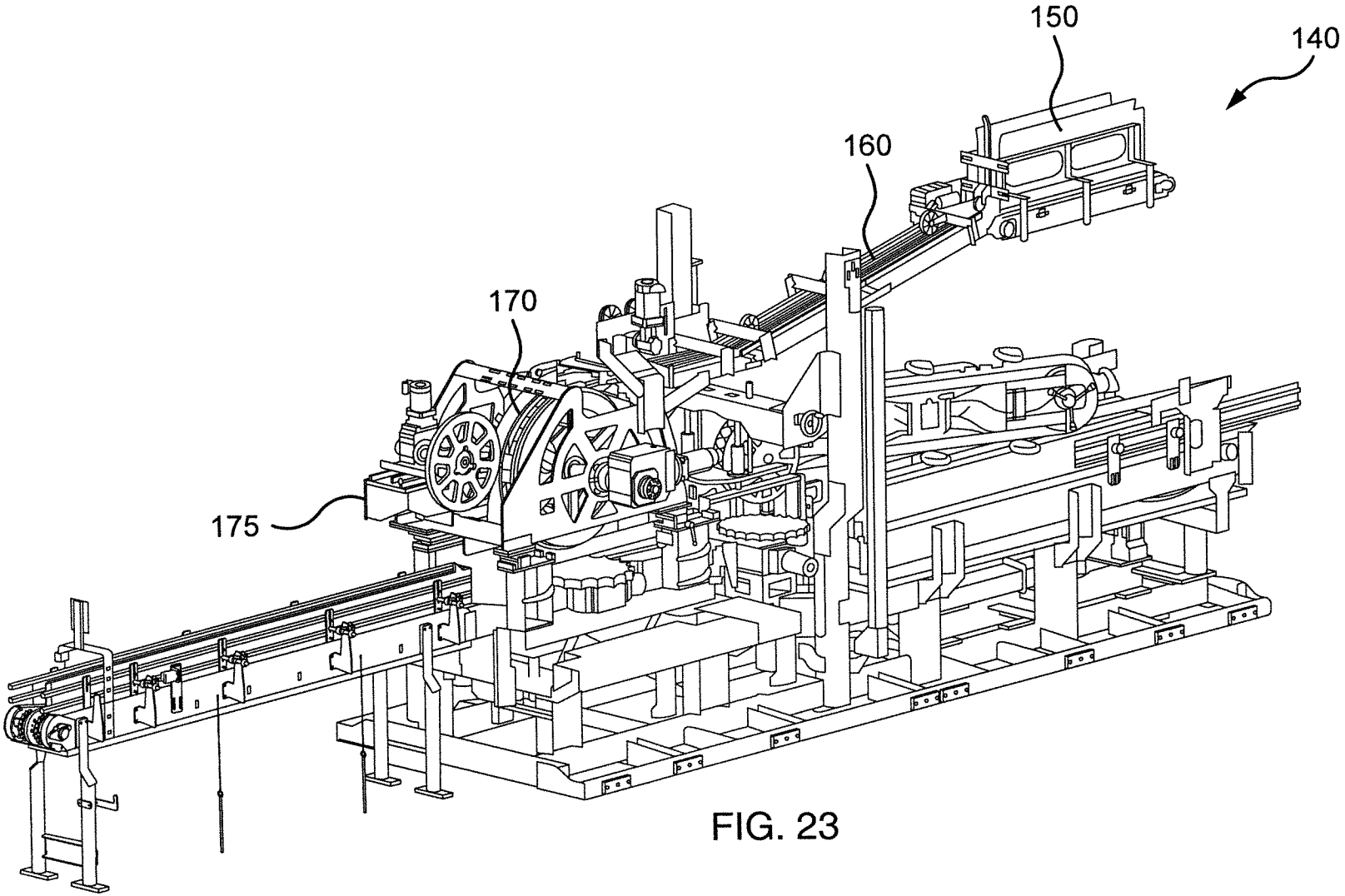
FIG. 23 shows a front perspective view of an applicating machine according to one embodiment.
Figure 24:
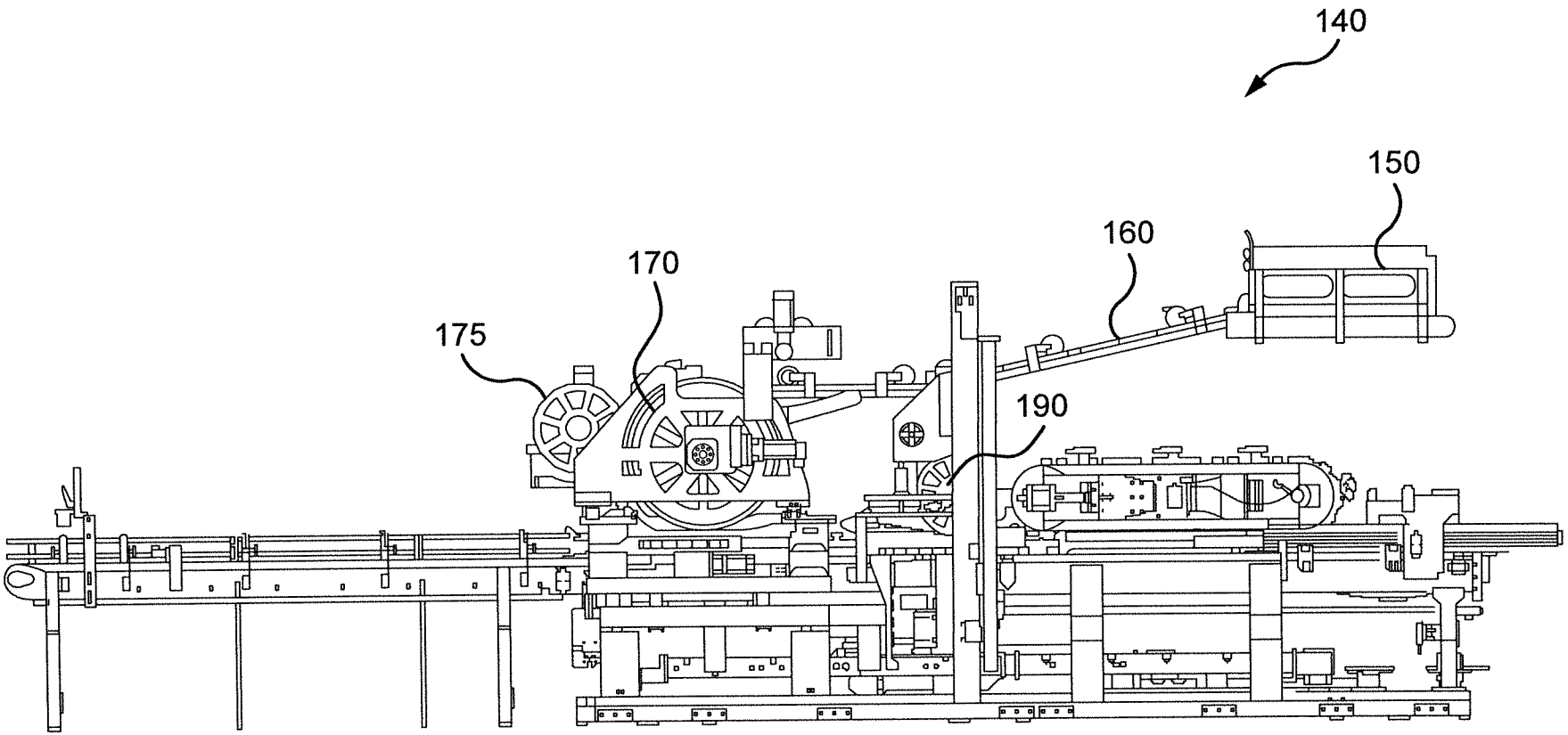
FIG. 24 shows a side view of the applicating machine shown in FIG. 23.
Figure 25:
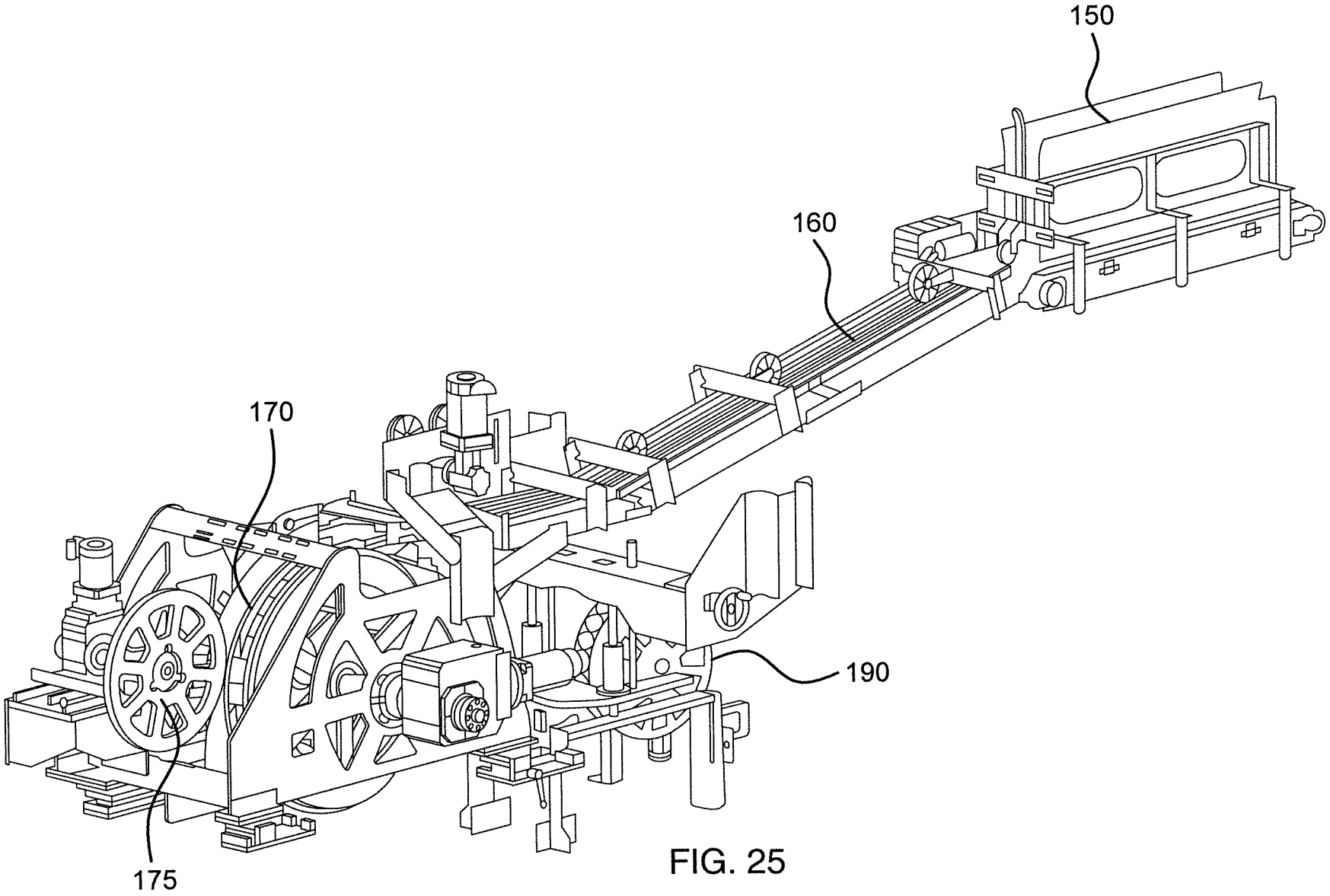
FIG. 25 shows a front perspective view of a portion of the applicating machine shown in FIG. 23.
Figure 26:
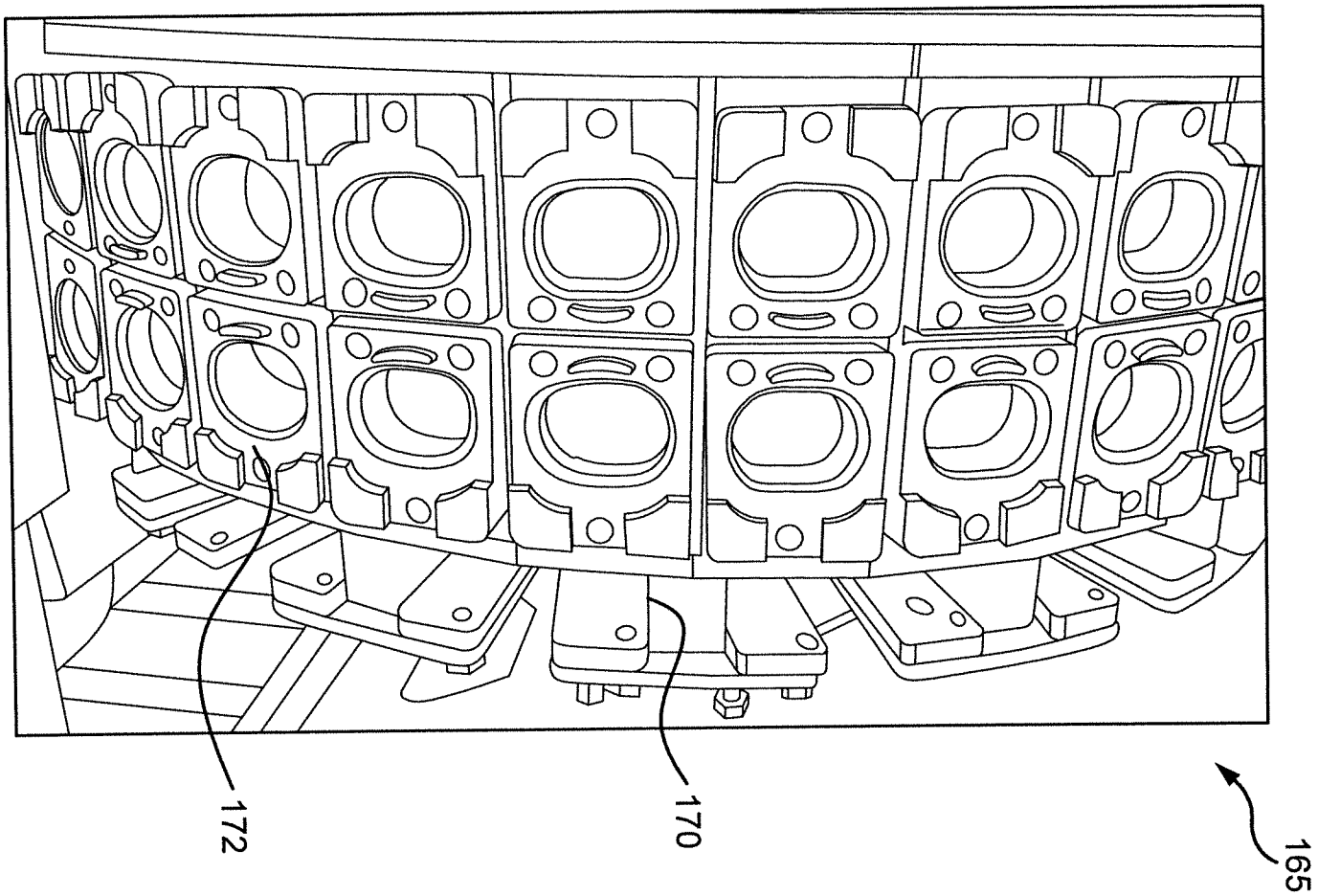
FIG. 26 shows a front view of an application drum according to one embodiment.
Figure 27A:
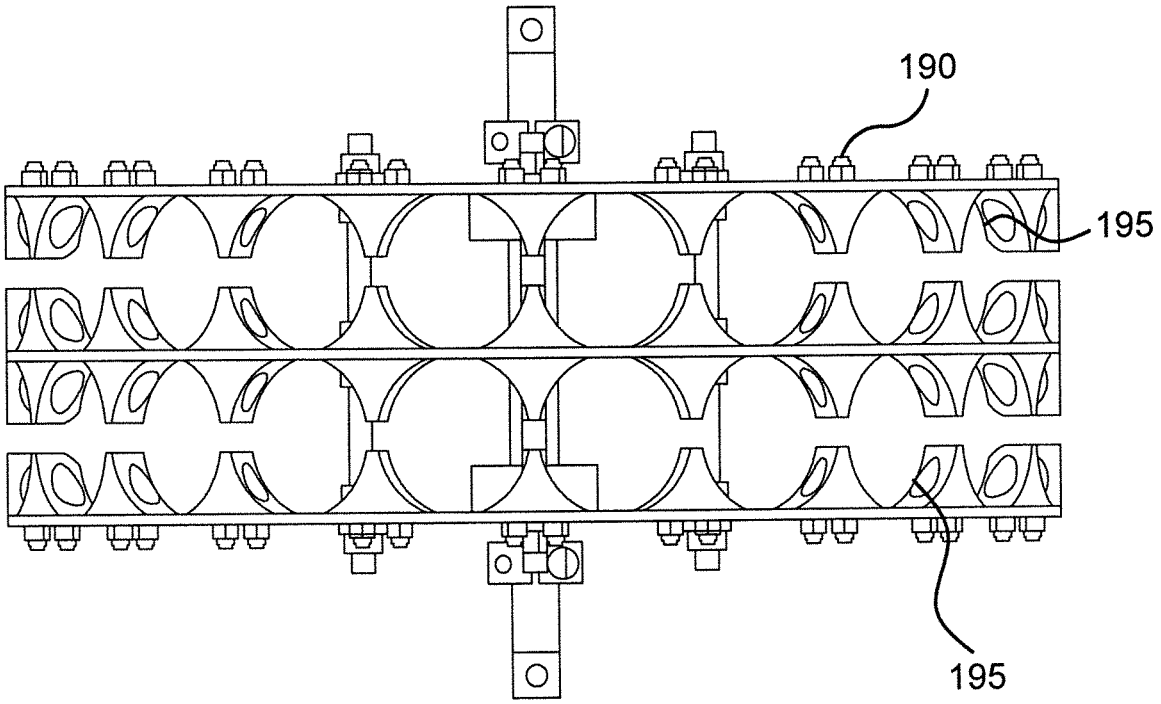
FIG. 27A shows a top view of a push down wheel according to a preferred embodiment.
Figure 27B:
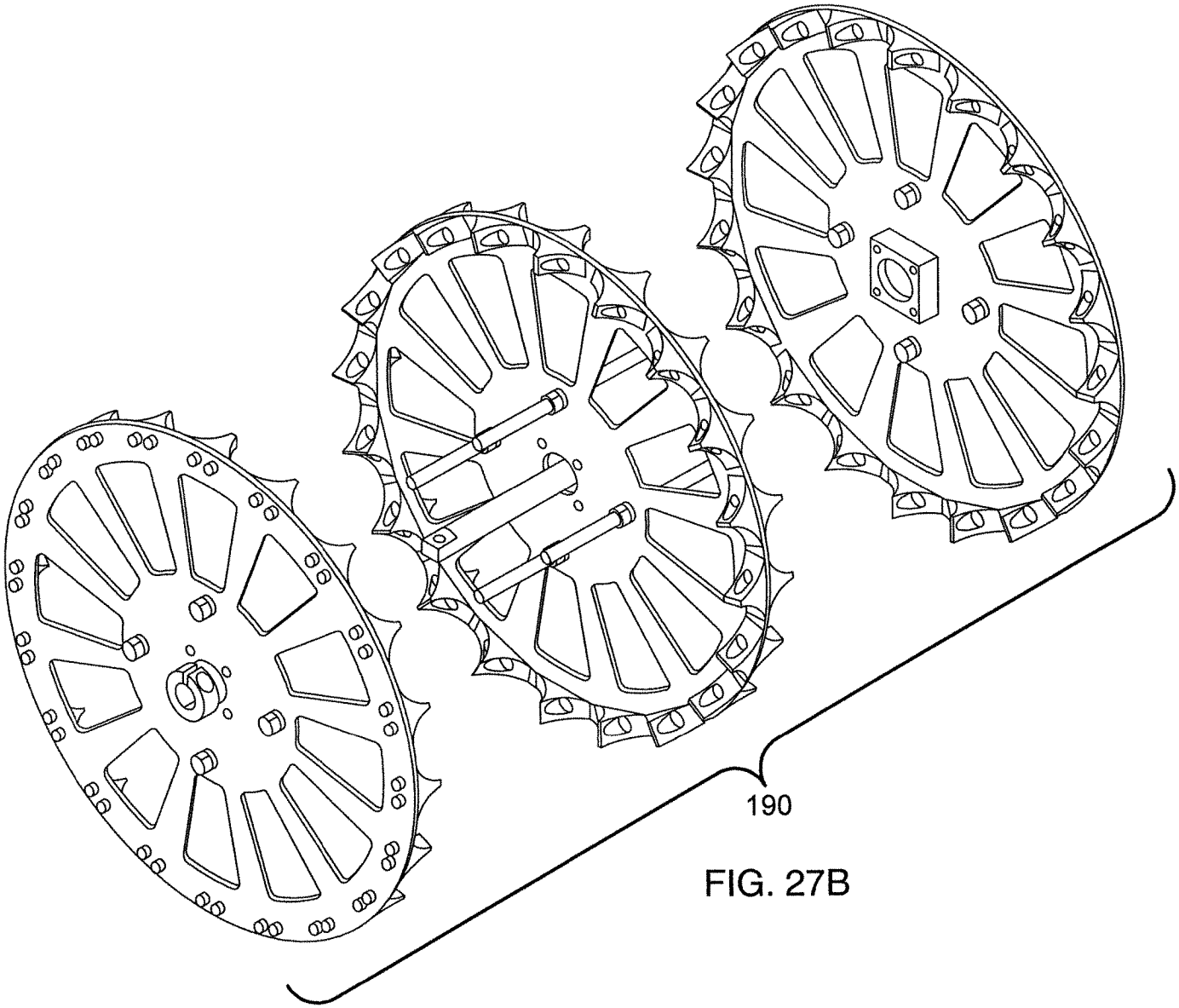
FIG. 27B shows an exploded perspective view of the push down wheel shown in FIG. 27A.
Figure 27C:
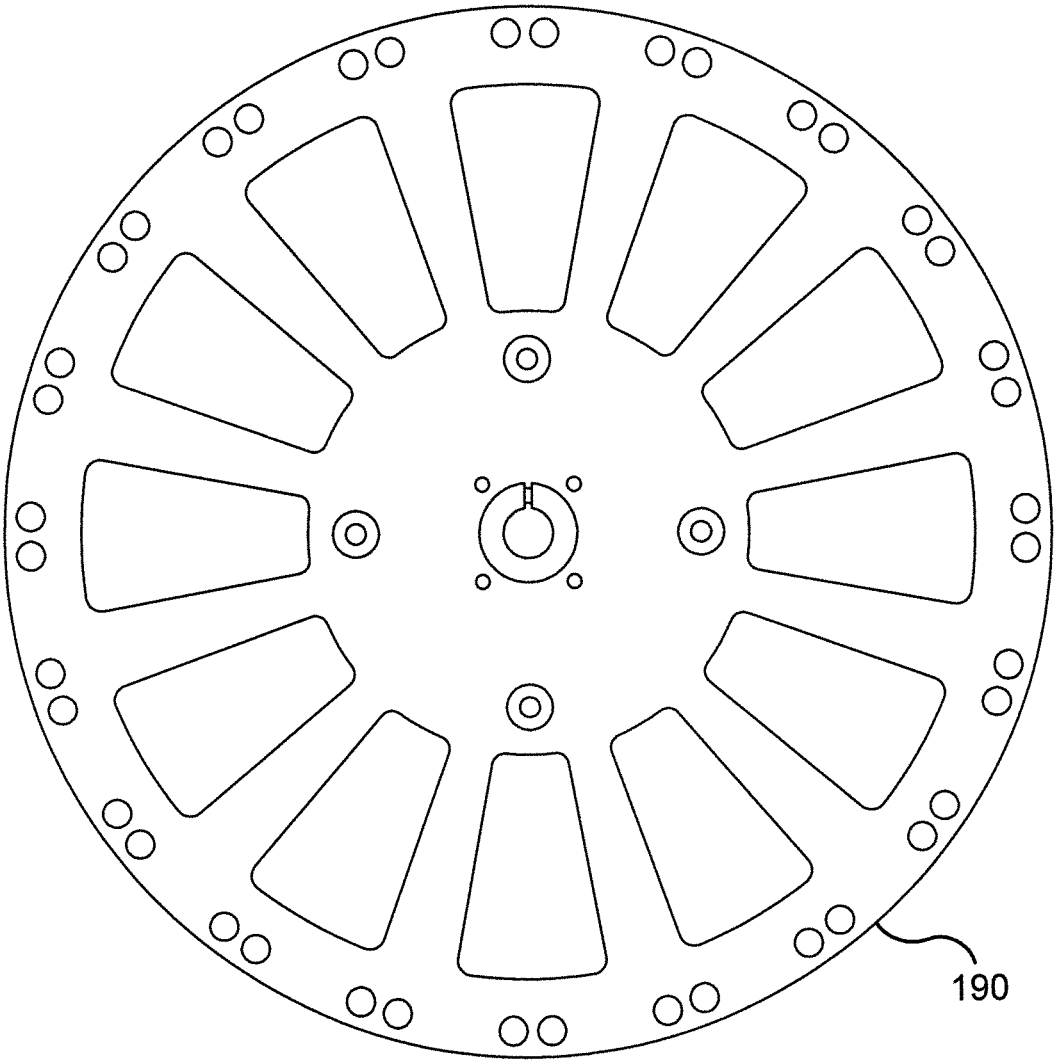
FIG. 27C shows a side view of the push down wheel shown in FIG. 27A.
Figure 27D:
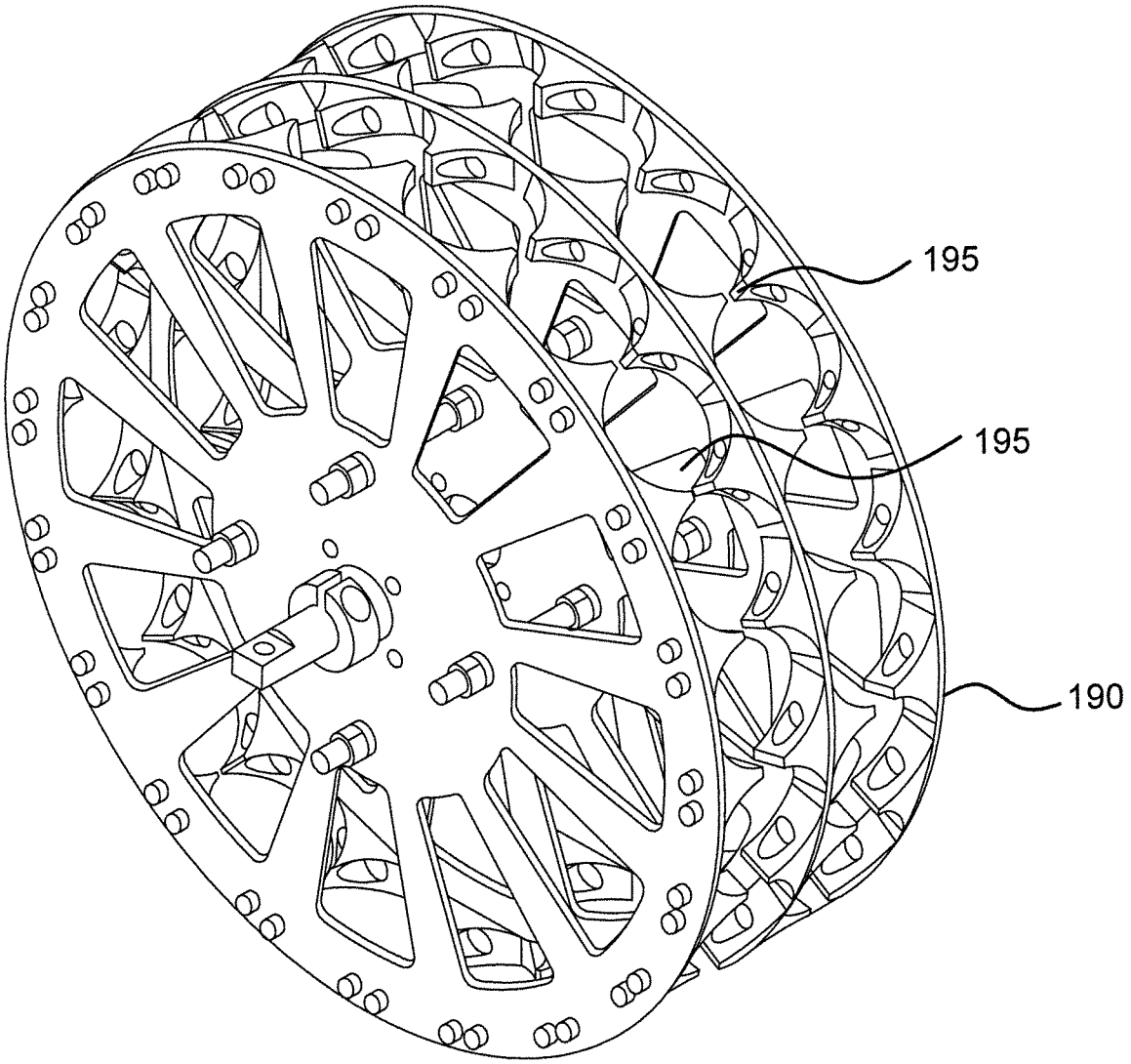
FIG. 27D shows a perspective view of the push down wheel shown in FIG. 27A.

FIG. 8 shows a schematic of one preferred embodiment of the subject invention wherein a feed apparatus 80 provides a supply of carriers 10 to a transport system and on to an application drum 170. In this preferred embodiment a belt 160 is used to transfer carrier between the feed apparatus and the application drum 170.

FIGS. 9-16 show preferred embodiments of a carrier feed apparatus 80 for the subject system for applying a container carrier 10 preferably includes the magazine 85 of container carriers 10 provided from the staging apparatus 50. The magazine 85 is preferably transferred from a staging portion of the subject system and includes a vertical stack 88 of container carriers 10 loaded into a magazine 85. The capacity of the magazine 85 is preferably such that an operator, or apparatus such as a robot, replenishing the magazine has adequate time to refill the magazine to provide continuous operation of the applicating system. In one preferred embodiment, one or more photoeyes 126, 127 are located in the magazine 85 to monitor the carrier stack 88 height. In one embodiment, an upper photoeye 126 detects when the carrier stack reaches the level at which additional carriers are needed and a lower photoeye 127 detects when the carrier stack height has dropped below the functional minimum required level of carriers.

The magazine 85 is preferably configured to hold the carrier stack 88 in place and prevents carriers within the stack from moving out of position. A leading edge carrier support bar 109 of the magazine vertically supports the leading edge of the carrier stack 88. Multiple carrier support rails 106 and a carrier support plate 107 in the magazine 85 also support a lower end of the stack of carriers 10. To avoid undesirable carrier movement and locate the carrier stack in the front-to-back direction, the magazine 85 preferably includes a front fixed vertical guide member 101 and a rear adjustable vertical guide member 102 which can be moved in the horizontal direction to accommodate carriers of different lengths. Stack side guides 103 in the magazine are positioned on each side of the stack to locate the lateral position and restrict lateral movement of the bottom of the stack. The magazine 85 also locates the carrier stack upstream of a pair of nip rollers 116 and 117 by an escapement bar 105.

Feeding of carriers 10 through the system is preferably accomplished by advancing the bottom carrier 10 of the stack 88 with reciprocating feed lugs 108 which are guided by linear bearings 118 and a linear bearing rail 119 to restrict the back and forth movement to the direction in which the carriers are to be fed. The feed lugs 108 are positioned vertically to protrude above the carrier support rails 106 to engage only with the bottom carrier and advance it into the grip of the nip rollers. The escapement bar 105 is vertically positioned above the leading edge carrier support bar 109 and carrier support rails 106 to only allow the bottom carrier to be advanced from the carrier stack. In this embodiment, the escapement is fixed vertically for carriers of a single thickness, a vertical adjustment could be implemented to accommodate carriers of various thicknesses. The feed lugs 108 are arranged and fixed to a mounting plate 110 with keyhole slots 111. The feed lugs 108 and mounting plate 110 preferably comprise change parts within the system for carriers 100 of a specific size and shape. The keyhole slots 111 are used to connect the mounting plate 110 to a reciprocating plate 112 which has mating keyhole pins 113. The mounting plate 110 may be further held in place with two latching toggle clamps 120. The keyhole mounting design allows feed lug arrangements for different carriers to be quickly changed out.

The reciprocating plate 112 movement is achieved, in this embodiment, by a servomotor 122 coupled to a planetary gearbox 121 with a pinion 115 attached to its output shaft. The pinion 115 drives a rack 114 attached to the reciprocating plate 112. Actuation of the reciprocating plate 112 may also be accomplished by other suitable means to achieve the desired oscillating motion, such as a crank-rocker mechanism, multiple-bar linkage, indexer, or Geneva wheel. The servomotor 122 motion is programmed such that the forward motion of the feed lugs 108 begins slightly behind the point of engagement with the bottom carrier. The feed lugs then move forward, engage with the bottom carrier, and advance it forward until the nip rollers 116 and 117 grip the bottom carrier with sufficient force to continue pulling it from the bottom of the stack and away from the feed lugs. The upper nip roller 116 has a urethane outer coating with sufficient hardness to apply pressure to the bottom carrier, yet soft enough to have some compliance as to grip the carrier without causing damage. It should be noted that the forward motion of the bottom carrier during the handoff to the nip rollers is such that its forward velocity matches the velocity of the nip rollers before they grip the carrier. The upper nip roller is mounted in support bearings 125 allowing it to rotate freely. The upper nip roller 116 is also fixed vertically for carriers of a single thickness, although a vertical adjustment could be implemented to accommodate carriers of various thicknesses. The lower nip roller 117 is a steel roller which has a straight longitudinal knurl pattern to provide a firm grip on the carrier. The lower nip roller is in a fixed location and is connected to a right angle gearbox 123 driven by a servomotor 124.

The servomotor speed is preferably controlled to drive the outer surface of the lower nip roll at the same linear velocity as the applicator drum 170 downstream. As the nip rollers continue to advance the bottom carrier, the feed lugs are simultaneously retracting to be in position for the next carrier feed. The trailing edges of the feed lugs are tapered to prevent them from disturbing the carriers above as the lugs retract. Since the function of the reciprocating feed is to advance the carriers from the escapement bar into the grip of the nip rolls, and the feed lugs are adjustable to the position of the front edge of the stack, but the stroke of the feed lugs need not be adjustable. Successive carriers are fed in turn with a relatively small, controlled space between them regardless of the length of the carrier.

FIGS. 17-19, 20-22 and 23-25 show three preferred embodiments of a system and apparatus for applying container carriers 10 to individual containers 100. According to preferred embodiments, the magazine 85 of stacked carriers dispenses individual carriers and/or sticks 90 of carriers 10 one at a time from the magazine to an applicating drum 170. The sticks 90 are preferably dispersed from a bottom of the stack of sticks in the magazine 85 and channeled one stick at a time successively. In this embodiment, the applicating machine 140 translates a vertical stack of carrier sticks 90 to a horizontal queue of carrier sticks while also closing any gaps between carrier sticks 90 in the queue. In this manner, a constant stream of carrier sticks 90 is presented to the applicating drum 170 without interruption.

In one preferred embodiment of the magazine 85, an escapement bar may be used to maintain the stack of carriers 10 in position prior to release and a hold down wheel may be position along a continuously moving belt 160.

According to one preferred embodiment, shown in FIG. 8, a continuous belt 160 pulls each lower carrier stick 90 from the magazine 85 and drives it toward the applicating drum 170 in a continuous manner. In this embodiment, the associated belt 160 preferably operates at a higher speed than the applicating drum 170 in order to eliminate gaps between adjacent sticks 90 of carriers 10. In another preferred embodiment, shown in FIG. 9-16, a set of pins or shoes continuously and repeatedly engages and pulls each carrier stick 90 toward the applicating drum 170 in a repeated continuous manner. In this embodiment, the drive system positively engages each carrier stick 90 to ensure continuous supply of adjacent carrier sticks 90.

Once received in the applicating drum 170, each carrier stick 90, of two or more container carriers 10, is engageable with the applicating drum 170. In one embodiment, the applicating drum 170 includes indexing pins or carrier shoes 172 that engage with a portion of the carrier stick 90, such as within the container receiving apertures 30 or within central index apertures in the carrier stick 90. As the applicating drum 170 rotates, the carrier sticks 90 are bent around the circumference of the applicating drum 170 for engagement with sets of containers 100.

As the applicating drum 170 continues its rotation, the individual carriers 10 are dropped somewhat loosely around respective container necks or chimes. This results in a desired grouping of containers, such as six containers, with an associated carrier placed or draped on the grouping. In one embodiment, this loose association between the carrier 10 and the containers 100 does not yet result in a viable package 120. Instead, this set of carriers 10 and associated containers 100 then preferably proceeds to a second stage—the push down wheel 190.

As schematically shown in FIGS. 4 and 5, a system for applying container carriers 10 to unitize a plurality of containers 100 includes a supply of container carriers 10 and an applicating drum 170 configured to accept the supply of container carriers 10 and apply one or more container carriers 10 to a corresponding group of containers 100. An applicator 165 is configured to move the one or more container carriers 10 from a first position in loose engagement with the group of containers 100 into a second position in final engagement with the group of containers 100 and thereby form a package of unitized containers.

According to a preferred embodiment, in the final engagement, the one or more container carriers 10 engage with a surface feature of a corresponding container of the plurality of containers. The surface feature may comprise a circumferential groove in a bottle or a chime of can. Alternatively, in the final engagement, the one or more container carriers 10 may engage with a predetermined height of the container 100.

Figure 28:
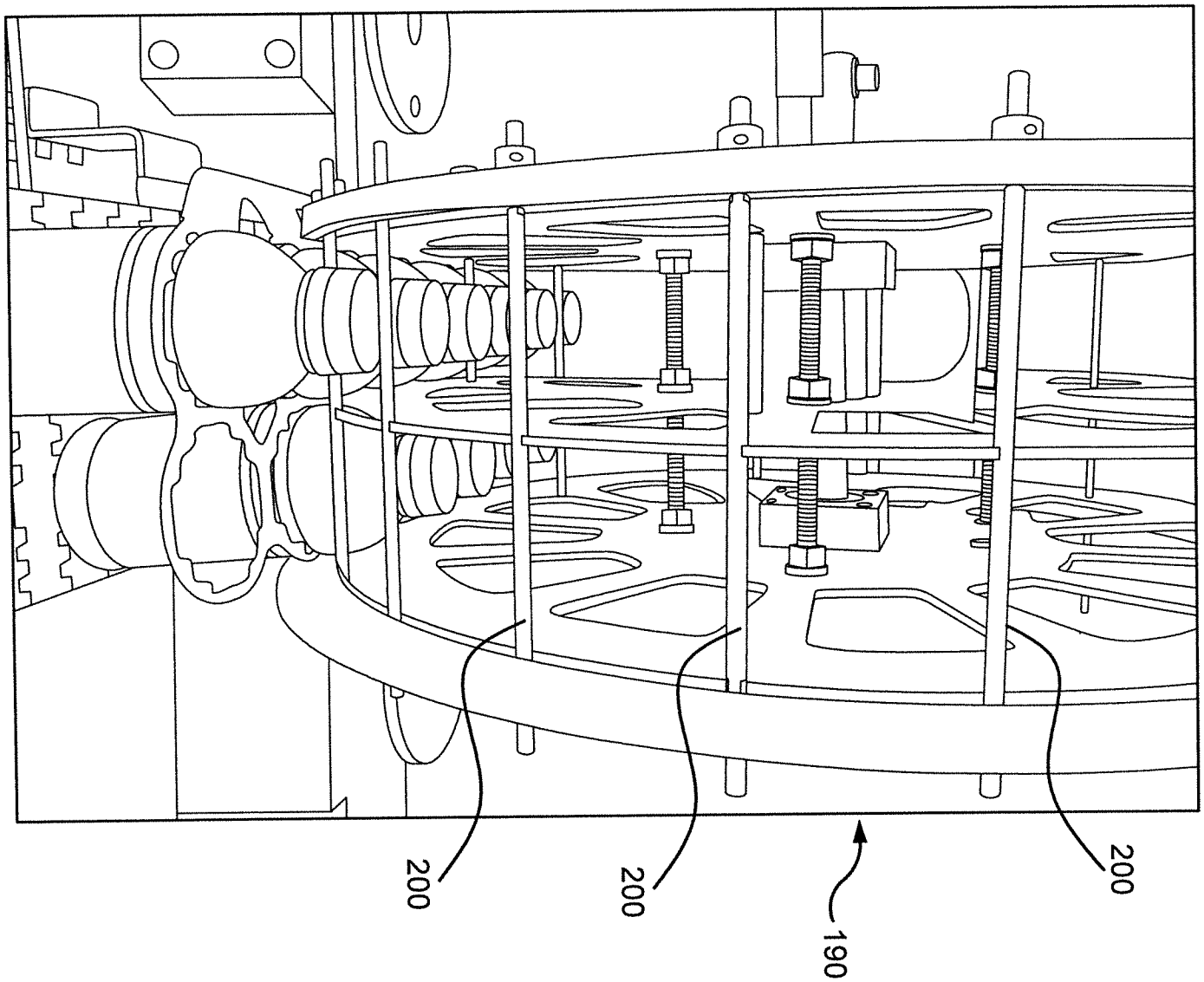
FIG. 28 shows a front view of a push down wheel according to one embodiment.
Figure 29:
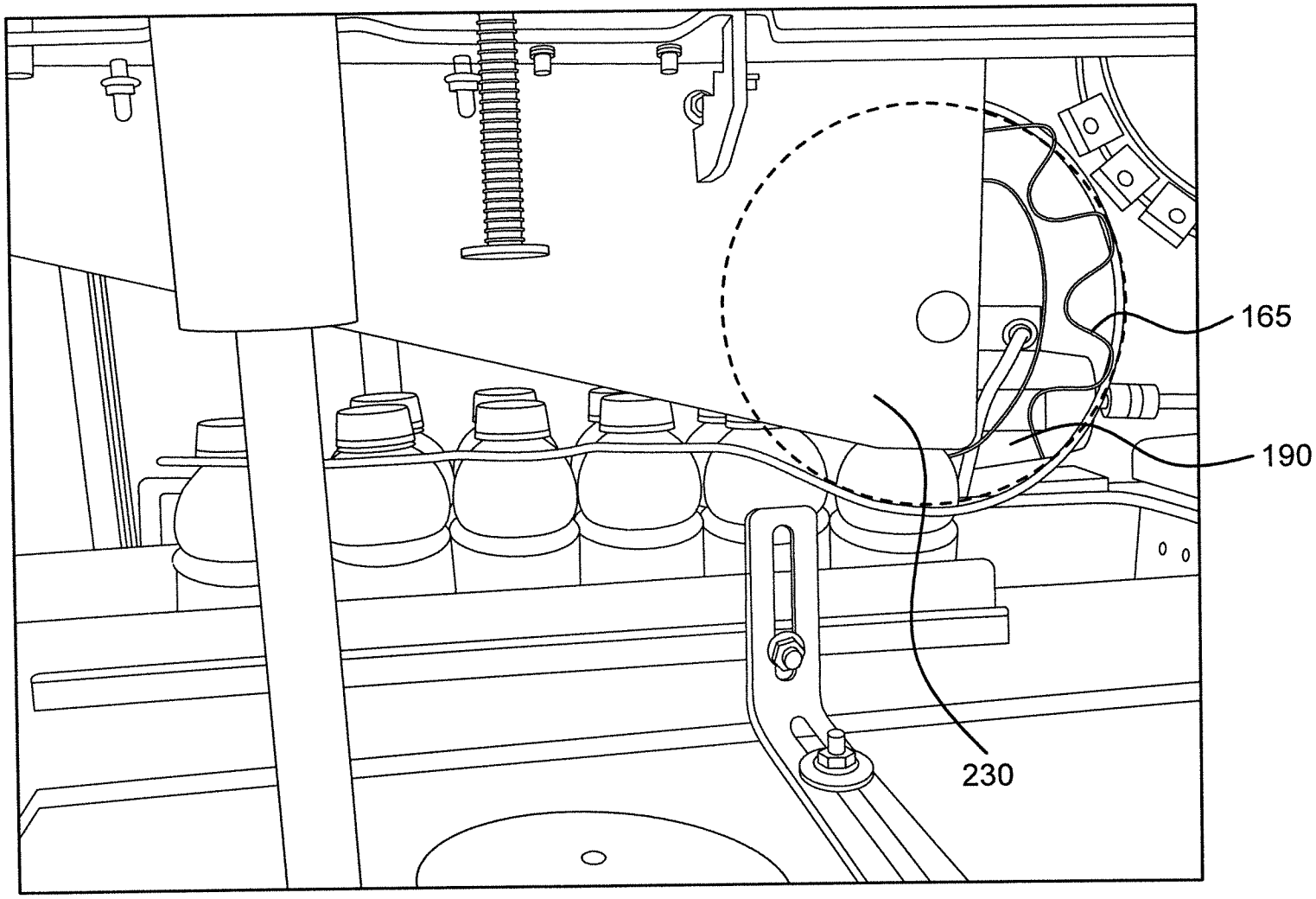
FIG. 29 shows a side view of a push down wheel according to one embodiment.

According to one embodiment, shown schematically in FIGS. 4 and 5 and in additional detail in FIGS. 27-29, the applicator 165 may comprise a push down wheel 190. The push down wheel 190 is preferably configured to generally synchronize with the applicating drum 170, either in a geared manner or with servos. The push down wheel 190 is used to move the container carriers 10 from loose engagement into final engagement with the containers 10. In one embodiment, shown in FIG. 27, the push down wheel may comprise a plurality of pairs of collars 195 spaced circumferentially around the push down wheel 190. The collars 195 preferably individually engage around ends of respective containers as the carrier 10 is urged thereon. The plurality of pairs of collars 195 are preferably positioned below an outer engagement diameter of the applicating drum 170.

Figure 30:
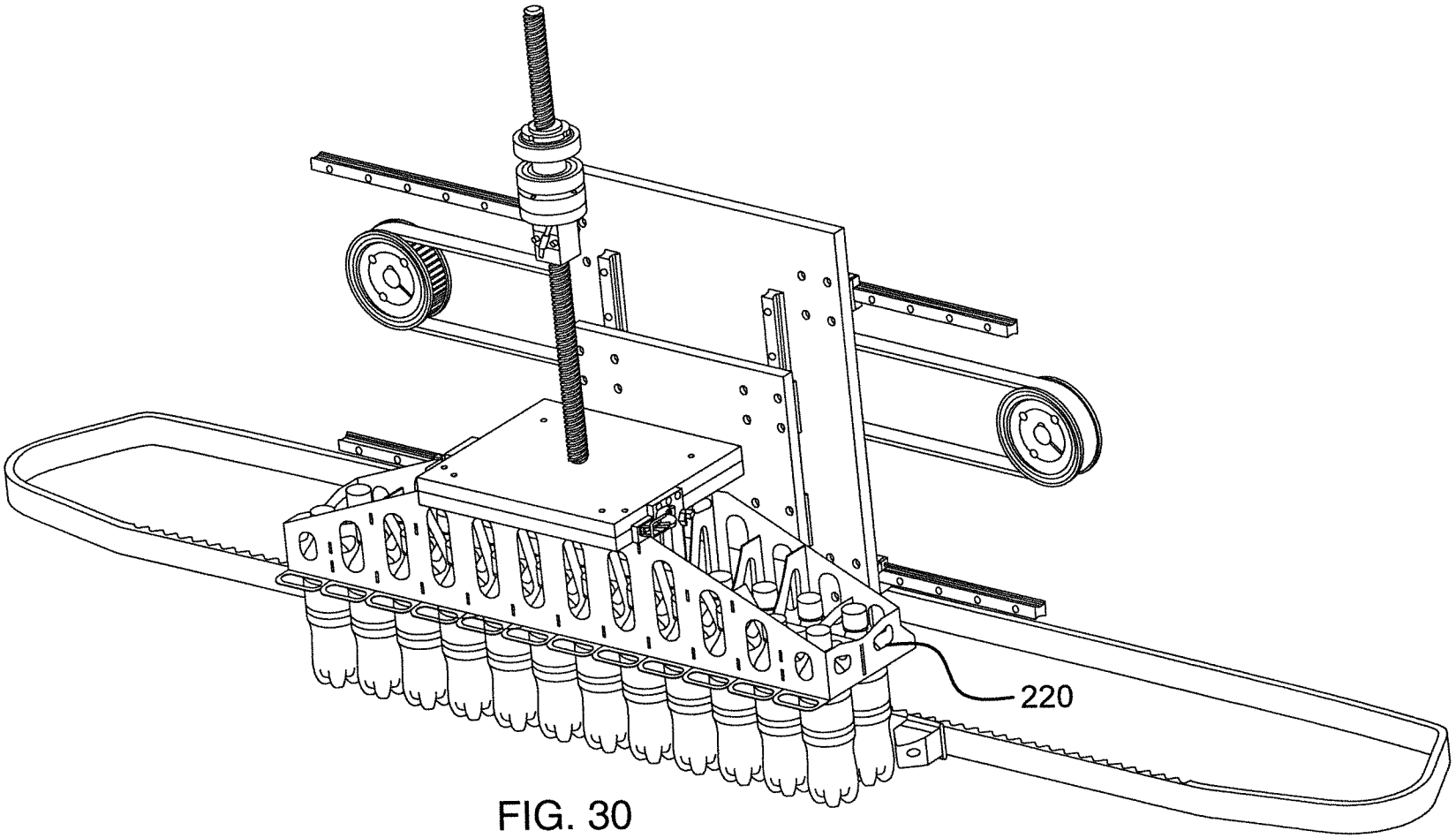
FIG. 30 shows a perspective view of an applicator according to one embodiment.

Alternatively, as shown in FIG. 28, the push down wheel 190 may comprise a plurality of bars 200 positioned circumferentially around the push down wheel 190, each bar 200 of the plurality of bars spaced to extend between pairs of containers. As shown in FIG. 30, the applicator 165 may alternatively comprises a rotary stomper 220 to push individual carriers onto groups of containers.

In each preferred device, the applicator 165 preferably drops the one or more container carriers 10 over necks of respective containers 100, such as bottles. In the final engagement, preferably enabled with the applicator 165, the one or more container carriers 10 engage with a surface feature of a corresponding container of the plurality of containers. Alternatively, in the final engagement, the one or more container carriers engage with a predetermined height of the container.

According to one embodiment, the applicator 165 may comprise a tapered plate 230 positioned within a rotation of the push down wheel 190. As shown in FIG. 29, as the push down wheel 190 rotates across the carrier 10, the tapered plate 230 urges the carrier 10 between the first position and the second position.

In one preferred embodiment, a radius of the push down wheel 190 is vertically lower than a radius of the applicating drum 170. The push down wheel 190, best shown in isolation in FIGS. 27 and 28, preferably includes a plurality of collars located in pairs around a circumference of the push down wheel 190. Specifically, the plurality of pairs of collars are preferably positioned below an outer engagement diameter of the applicating drum 170. As the push down wheel 190 is rotated over the containers 100 and the associated carrier 10, the respective collars preferably forcibly lower the container receiving apertures 30 of the respective carrier 10 into full engagement with respective containers 100. In one preferred embodiment, each container 100 includes a groove 110 or similar surface feature that positively engages with the ribs of the carrier forming each container receiving opening 30 within the carrier 10. Alternatively, the push down wheel 190 pushes the carrier 10 a predetermined distance down over the container 100.

FIGS. 27A-D shows various views of the push down wheel 190 according to one embodiment having collars in pairs as described above. FIG. 27 shows a front view of a push down wheel 190 according to an alternative embodiment wherein a plurality of bars 200 are spaced circumferentially around the push down wheel 190 and are spaced such that each bar is positioned between each pair of containers 100 as the push down wheel 190 is rotated over the containers 100.

Figure 31:
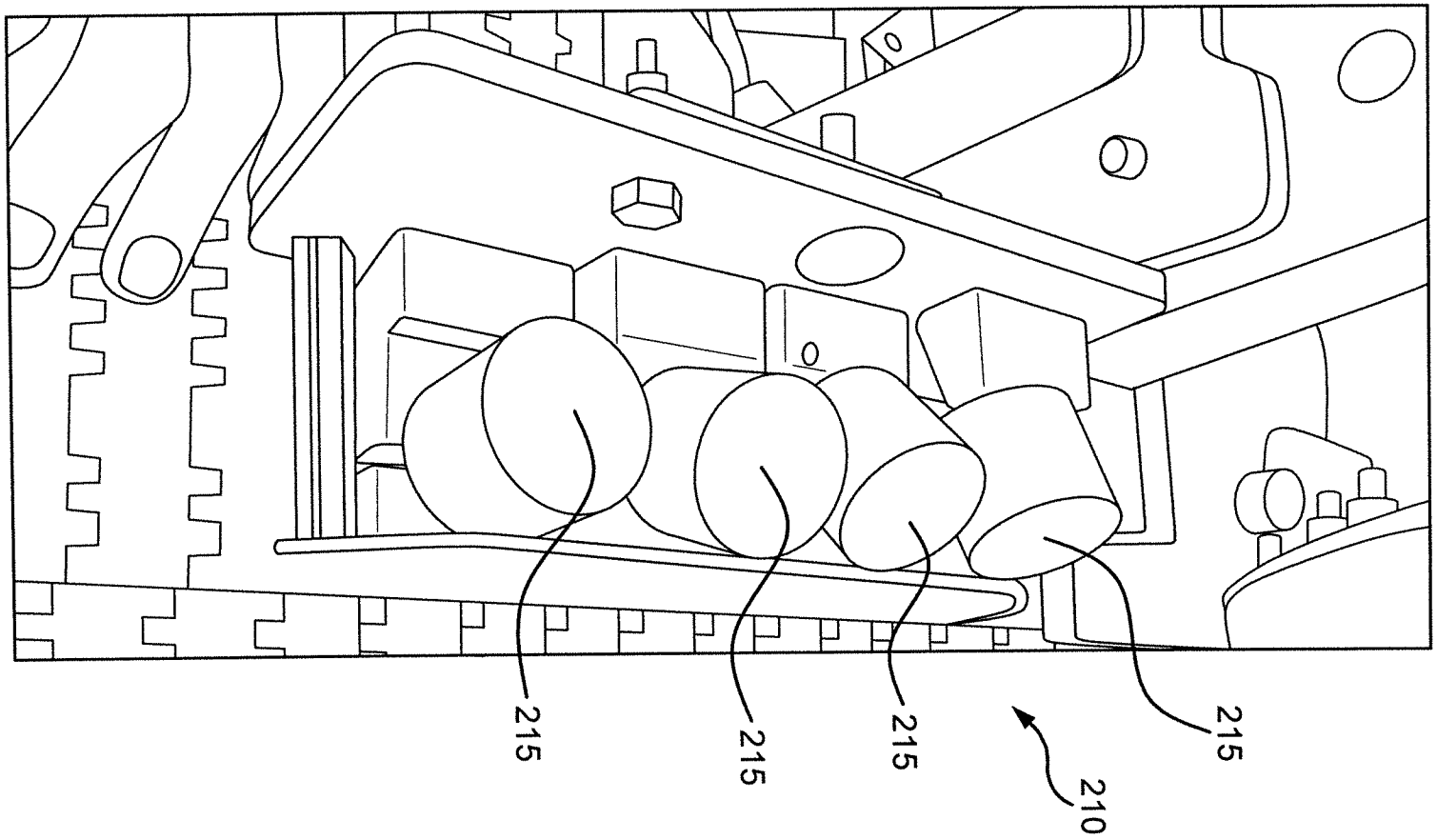
FIG. 31 shows a front perspective view of a roller assembly according to one embodiment.

Once applied into a finished package 120, the individual packages 120 may be directed through a path of travel that includes a fold down device for folding the handle 70 along the hinge 75 and into generally flat engagement with a side of the package 120. As shown in one embodiment in FIG. 31, the fold down device may comprise a roller stand 210 including two or more rollers 215 arranged in different alignments and configured to bend a handle 70 of the carrier 10 against the plurality of containers 100 into a generally flush position.

This flush handle 70 position enables more efficient shipping and shelf placement of the package 120. According to a preferred embodiment, a series of rollers 215 successively and iteratively fold the handle 70 over a plate to urge the handle 70 into a perpendicular position to a plane of the remaining carrier 10.

Figure 32:
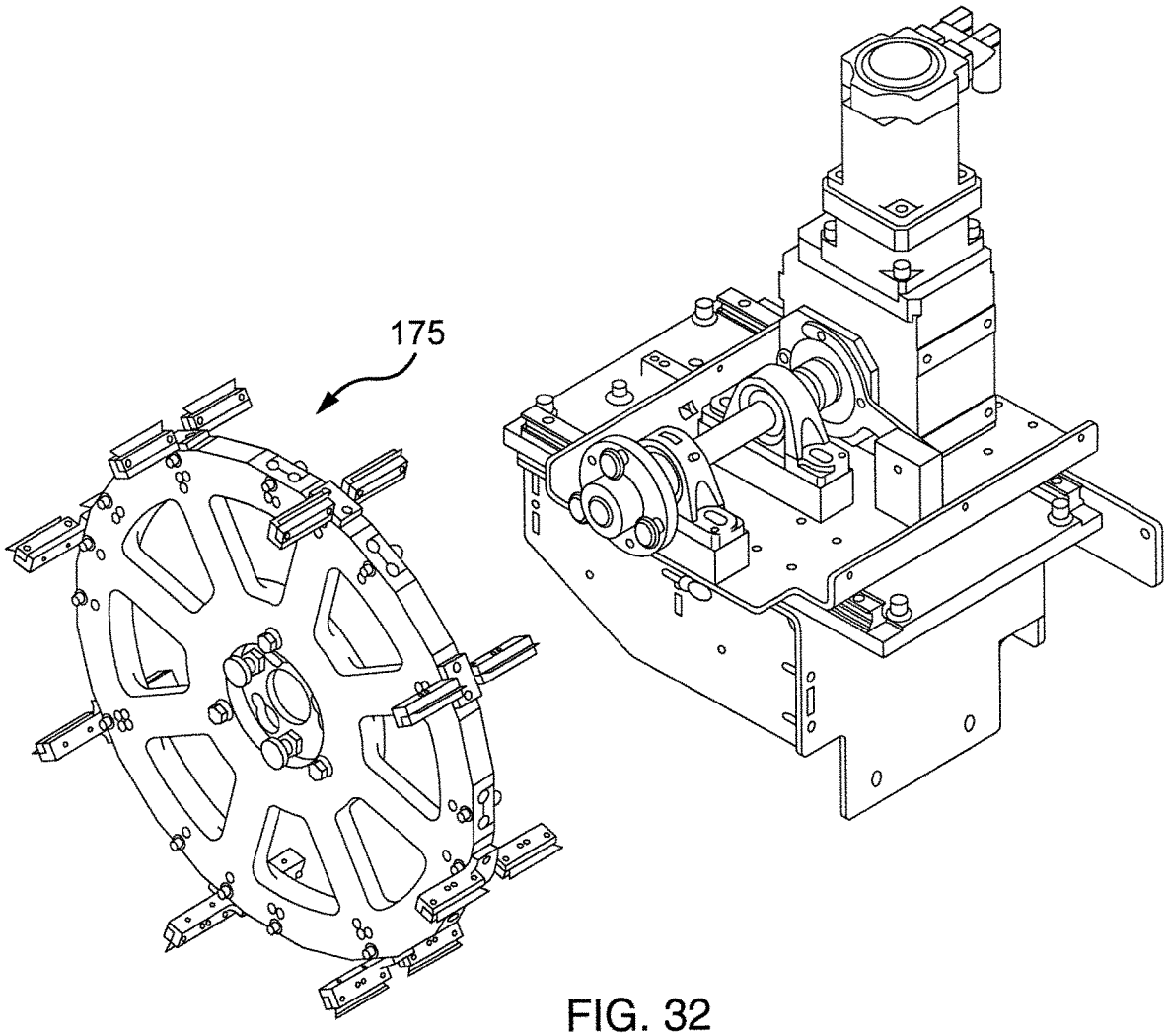
FIG. 32 shows a front perspective exploded view of a cutoff wheel according to one embodiment.
Figure 33:
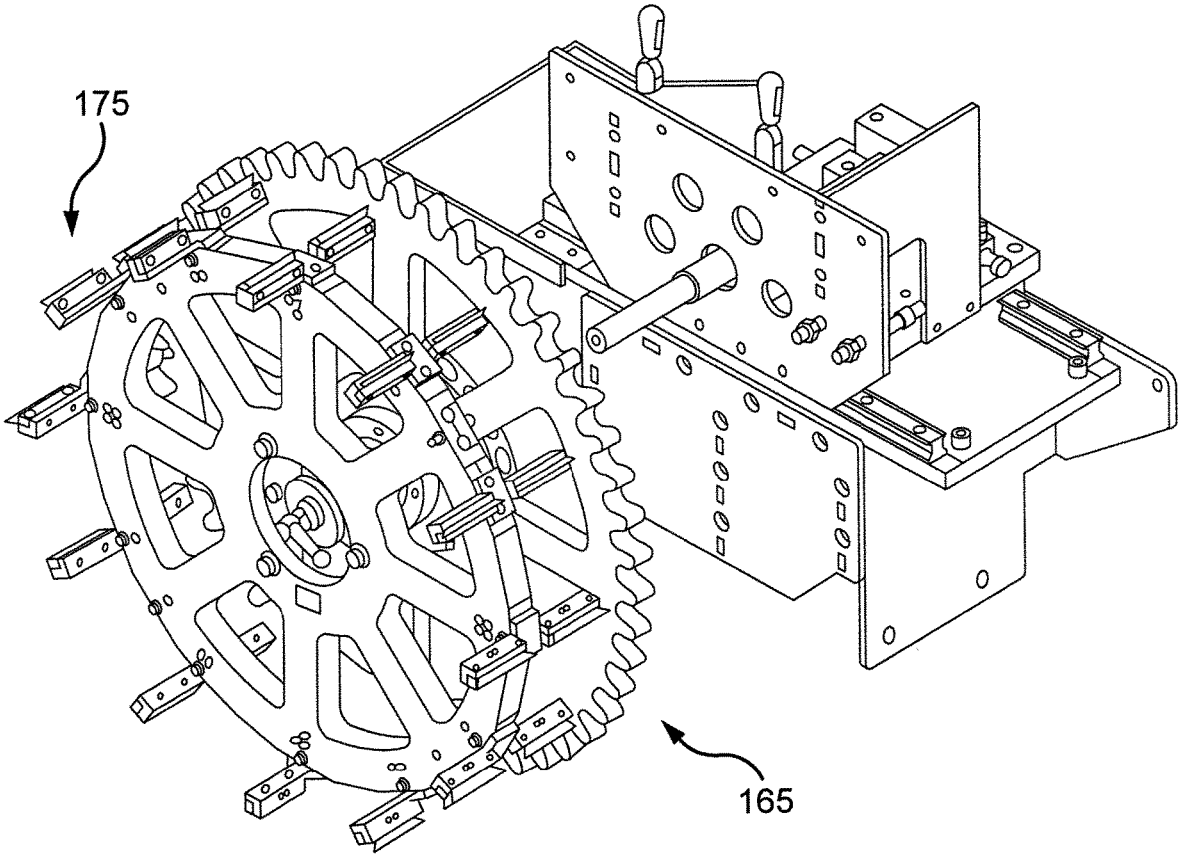
FIG. 33 shows a front perspective view of a cutoff wheel according to one embodiment.
Figure 34A:
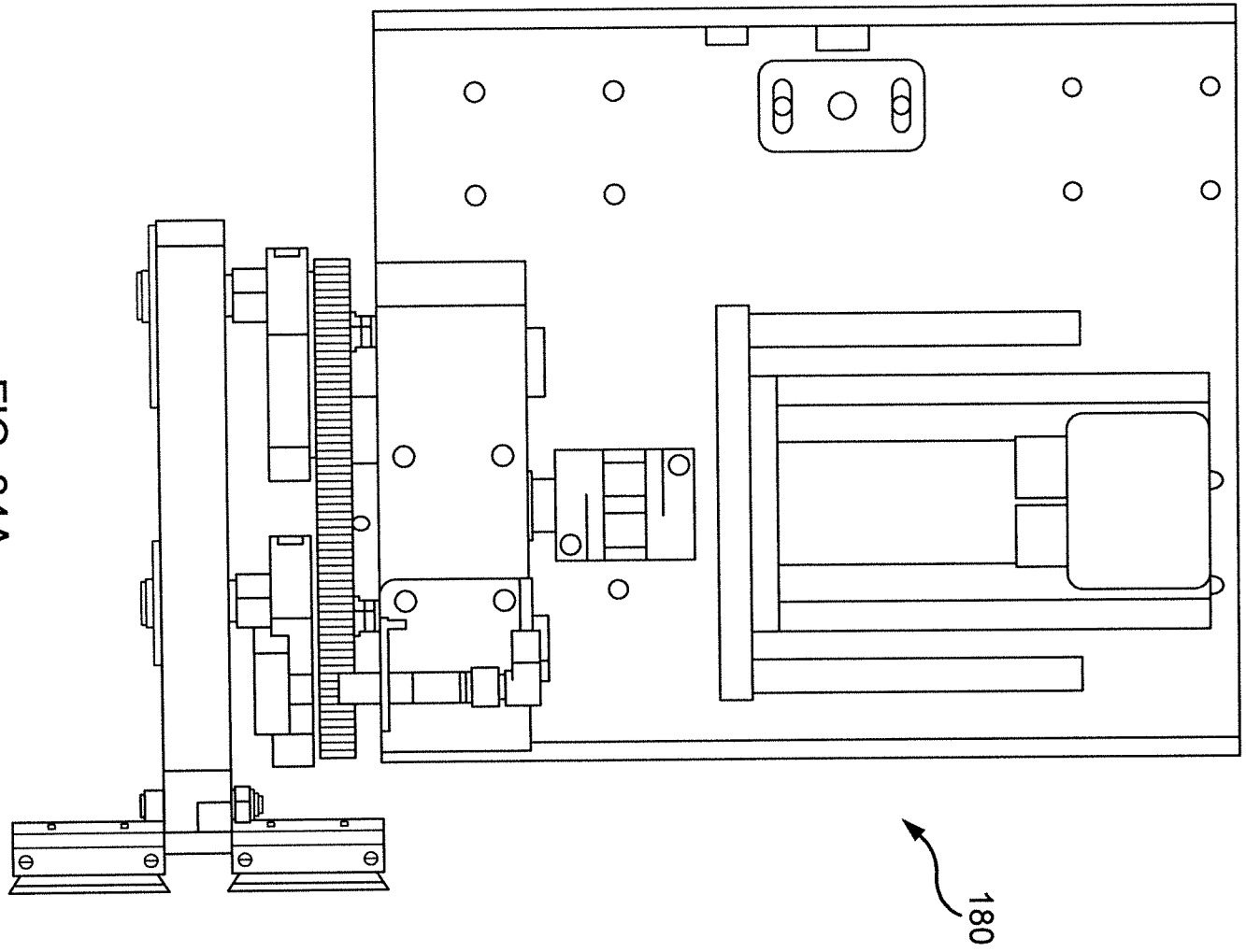
FIG. 34A shows a top view of a cutoff system according to a preferred embodiment.
Figure 34B:
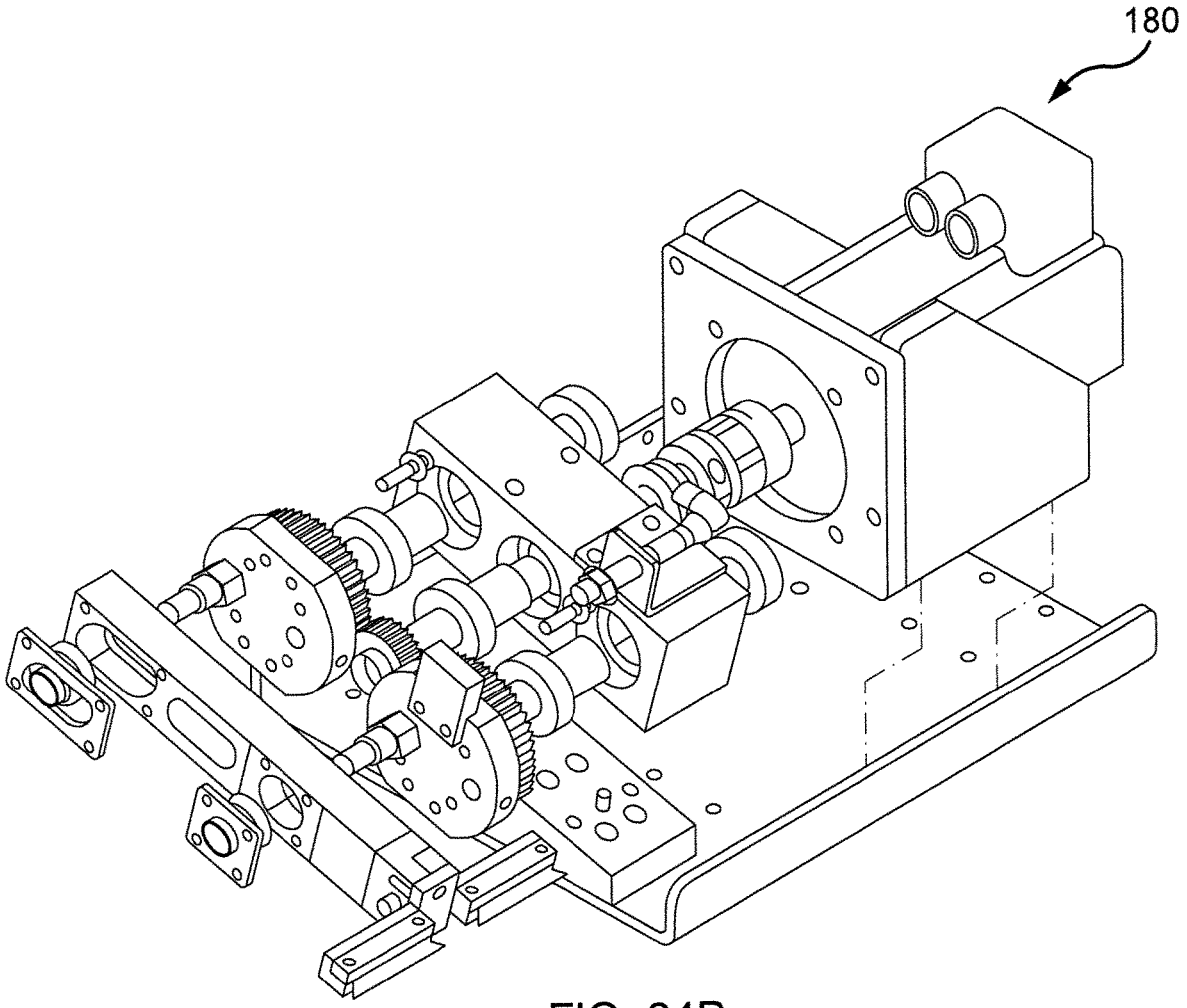
FIG. 34B shows a side perspective view of the cutoff system shown in FIG. 34A.
Figure 34C:
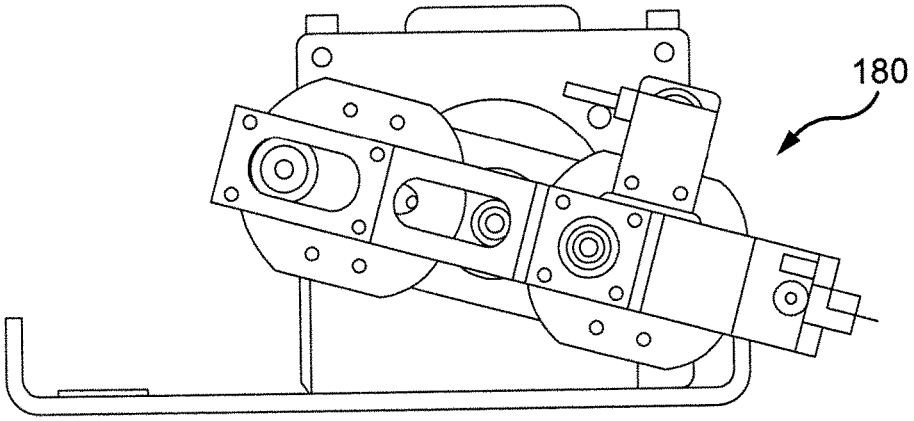
FIG. 34C shows a side perspective view of the cutoff system shown in FIG. 34A.
Figure 34D:
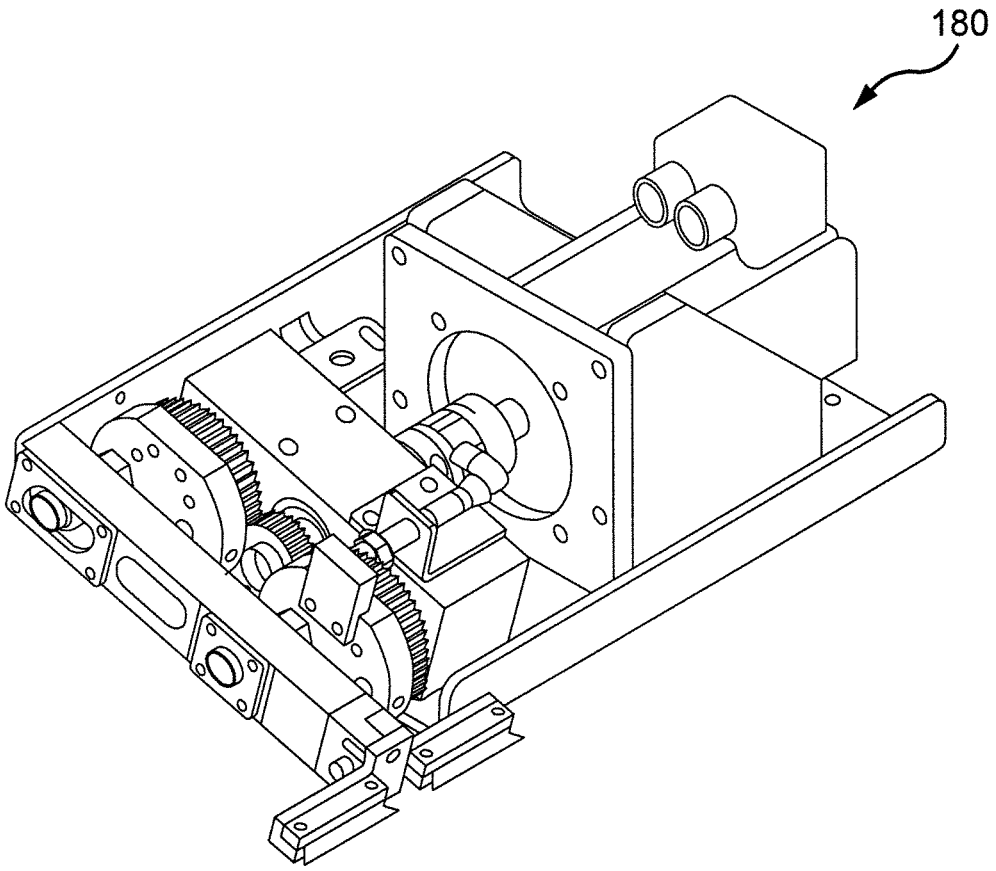
FIG. 34D shows a side perspective view of the cutoff system shown in FIG. 34A.

According to a preferred embodiment, a cutoff system 180, shown in FIG. 32-34, is presented as the carrier sticks 90 travel around the applicating drum 170. The cutoff system 180 may include a wheel with a plurality of circumferentially spaced knives, or knife pairs, such as shown in FIGS. 32 and 33. Alternatively, as shown in FIGS. 34A-34D, the cutoff system 180 may include a cammed knife that is synchronized with the applicating drum 170 and the desired size of each carrier 10 within the stick 90. Synchronization may be accomplished with servos, such as shown in FIG. 32, or direct gearing, such as shown in FIG. 33.

The cutoff knife splits the carrier stick 90 at the desired intervals while not interceding into the spaces between adjacent carrier sticks 90. Thus, for a stick of 4 carriers, the cutoff system will approach and sever three times within the stick but refrain from approach after the fourth carrier which is separate and already detached from the adjacent container stick 90. Alternatively, a cutoff wheel 175 such as shown in FIGS. 32 and 33 may be used which includes a series of blades fixed into position. The cutoff wheel 175 constantly rotates and the fixed knives thereby cut at constant intervals.

As described, the cutoff system 180 is configured to synchronize with the movement of the applicating drum 170. The cutoff system 180 thus may be configured to pause between unconnected sticks of container carriers, particularly an arrangement having an eccentric cammed knife as shown in FIGS. 34A-34D. Alternatively, in the cutoff system 180 having a plurality of knives spaced around a perimeter of the cutoff wheel, knives may be omitted from the perimeter of the cutoff wheel where adjacent unconnected sticks 90 are engaged. As such, every third station or every fourth station around the perimeter of the cutoff wheel 175 may omit a knife or knife pair.

The cutoff system 180 may be configured to cut the container carrier sticks 90 either before application while engaged with the applicating drum 170 or after application in the carrier 10 is in full engagement with the containers 100.

Packages 120 are then preferably directed through a turner/diverter to final processing such as cartooning, palletization and/or other packaging and/or distribution stages.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

The invention claimed is:

1. A system for applying a container carrier to unitize a plurality of containers, the system comprising:

a supply of container carriers provided in connected sticks of two or more container carriers;

an applicating drum configured to accept a single container carrier stick from a queue and provide to a supply of containers; and a cutoff system configured to selectively cut the connected sticks of two or more container carriers into individual container carriers but not intercede between adjacent unconnected sticks of container carriers, wherein the cutoff system includes an eccentric cam and a knife positioned along one edge of the eccentric cam.

2. The system of claim 1 wherein the queue of container carrier sticks includes no gaps between adjacent connected sticks of two or more container carriers.

3. The system of claim 1 wherein the cutoff system is configured to synchronize with a movement of the applicating drum.

4. The system of claim 3 wherein the cutoff system is configured to pause between unconnected sticks of two or more container carriers.

5. The system of claim 1 wherein the cutoff system is configured to cut the connected sticks of two or more container carriers while engaged with the applicating drum.

6. The system of claim 1 further comprising a push down wheel configured to move the container carrier from a first position in loose engagement with the plurality of containers into a second position in final engagement with the plurality of containers and thereby form a package of unitized containers.

7. The system of claim 6 wherein the cut-off system is configured to cut container carriers following final engagement with the plurality of containers.

8. A system for applying a container carrier to unitize a plurality of containers, the system comprising:

a supply of container carriers provided in connected sticks of two or more container carriers;

an applicating drum configured to accept a single container carrier stick from a queue and provide to a supply of containers; and a cut-off system configured to selectively cut the connected sticks of two or more container carriers into individual container carriers but refrain from approach between adjacent unconnected sticks of two or more container carriers, wherein the cutoff system comprises:

an eccentric cam; and a knife positioned along one edge of the eccentric cam, wherein the eccentric cam is configured to pause between unconnected sticks of container carriers.

9. The system of claim 8 further comprising a push down wheel configured to move the container carrier from a first position in loose engagement with the plurality of containers into a second position in final engagement with the plurality of containers and thereby form a package of unitized containers.

10. A system for applying a container carrier to unitize a plurality of containers, the system comprising:

a supply of container carriers provided in connected sticks of two or more container carriers;

an applicating drum configured to accept a single container carrier stick from a queue and provide to a supply of containers; and a cutoff system configured to selectively cut the connected sticks of two or more container carriers into individual container carriers but not intercede between adjacent unconnected sticks of container carriers, wherein the cutoff system comprises a cutoff wheel having a plurality of knives spaced around a perimeter of the cutoff wheel, each knife for engaging a portion of the connected stick of two or more containers, wherein individual knives of the plurality of knives are omitted from the perimeter of the cutoff wheel where adjacent unconnected sticks of two or more container carriers are engaged.

11. The system of claim 10 wherein the cutoff system is configured to cut the connected sticks of two or more container carriers while engaged with the applicating drum.

12. The system of claim 10 further comprising a push down wheel configured to move the container carrier from a first position in loose engagement with the plurality of containers into a second position in final engagement with the plurality of containers and thereby form a package of unitized containers.

13. The system of claim 12 wherein the cut-off system is configured to cut container carriers following final engagement with the plurality of containers.

* * * * *